US011017730B2

(12) United States Patent
Hwang et al.

(10) Patent No.: US 11,017,730 B2
(45) Date of Patent: May 25, 2021

(54) DISPLAY DEVICE AND DRIVING METHOD OF THE SAME

(71) Applicant: Samsung Display Co., Ltd., Yongin-si (KR)

(72) Inventors: Young Soo Hwang, Yongin-si (KR); Ji Woong Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/821,761

(22) Filed: Mar. 17, 2020

(65) Prior Publication Data

US 2020/0380919 A1 Dec. 3, 2020

(30) Foreign Application Priority Data

May 28, 2019 (KR) ..... 10-2019-0062609

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2360/04* (2013.01); *G09G 2380/02* (2013.01)

(58) Field of Classification Search
None
See application file for complete search history.

(56) References Cited

U.S. PATENT DOCUMENTS

| | | | | |
|---|---|---|---|---|
| 9,041,633 | B2 | 5/2015 | Park et al. | |
| 9,727,297 | B2 | 8/2017 | Eom | |
| 2005/0253778 | A1 | 11/2005 | Ku et al. | |
| 2017/0103702 | A1 | 4/2017 | Bi et al. | |
| 2018/0261163 | A1* | 9/2018 | Hyun | G09G 3/3266 |

FOREIGN PATENT DOCUMENTS

| | | | |
|---|---|---|---|
| KR | 10-0539263 | B1 | 12/2005 |
| KR | 10-1073226 | B1 | 10/2011 |
| KR | 10-2016-0036155 | A | 4/2016 |
| KR | 1020170031091 | * | 3/2017 |

* cited by examiner

*Primary Examiner* — Aneeta Yodichkas
(74) *Attorney, Agent, or Firm* — Lewis Roca Rothgerber Christie LLP

(57) ABSTRACT

A display device including multiple displays is provided. The display device includes a first display including first pixels; a second display including second pixels; a first driver configured to drive the first display; a second driver configured to drive the second display; a controller configured to control the first and second drivers; a first power supply configured to supply first power to the first and second displays; and a second power supply configured to supply second power to the first and second displays. The second power supply includes a first voltage source configured to generate a first voltage; a second voltage source configured to generate a second voltage; a first switch configured to couple the first display to any one of the first and second voltage sources; and a second switch configured to couple the second display to one of the first and second voltage sources.

16 Claims, 9 Drawing Sheets

DISPLAY DEVICE AND DRIVING METHOD OF THE SAME

CROSS-REFERENCE TO RELATED APPLICATION

This application claims priority to and the benefit of Korean Patent Application No. 10-2019-0062609, filed on May 28, 2019, the entire disclosure of which is incorporated herein in its entirety by reference.

BACKGROUND

1. Field

Various embodiments of the present disclosure relate to a display device and a driving method thereof.

2. Related Art

Recently, various forms of display devices, including foldable display devices, rollable display devices, and the like, have been developed. For example, a foldable display device includes multiple displays on both sides of the device, thereby being usable with the display device in both folded and unfolded states. Accordingly, the foldable display device may provide portable convenience while realizing a large screen according to need.

SUMMARY

Various embodiments of the present disclosure are directed to a display device including multiple displays and a driving method thereof.

An embodiment of the present disclosure may provide for a display device. The display device may include a first display including first pixels, a second display including second pixels, a first driver configured to drive the first display, a second driver configured to drive the second display, a controller configured to control the first and second drivers, a first power supply configured to supply first power to the first and second displays, and a second power supply configured to supply second power to the first and second displays. The second power supply may include a first voltage source configured to generate a first voltage, a second voltage source configured to generate a second voltage, a first switch configured to couple the first display to any one of the first and second voltage sources, and a second switch configured to couple the second display to any one of the first and second voltage sources.

In an embodiment, the first display may be driven in a display mode or a sensing mode. The first switch may couple the first display to the first voltage source when the first display is driven in the display mode, and may couple the first display to the second voltage source when the first display is driven in the sensing mode.

In an embodiment, the first voltage may be set to a low-level voltage that enables the first pixels to emit light, and the second voltage may be set to a high-level voltage that prevents the first pixels from emitting light.

In an embodiment, the second display may be driven in the display mode or the sensing mode, and may be driven in the sensing mode when the first display is driven in the display mode.

In an embodiment, the second switch may couple the second display to the first voltage source when the second display is driven in the display mode, and may couple the second display to the second voltage source when the second display is driven in the sensing mode.

In an embodiment, each of the first and second pixels may include a light-emitting element coupled between the power sources of the first power and the second power, a first transistor coupled between the power source of the first power and the light-emitting element and configured to control a driving current supplied to the light-emitting element in response to the voltage of a first node, a second transistor coupled between the first node and a data line, the second transistor being turned on when a scan signal is supplied to a scan line, a third transistor coupled between a sensing line and a second node, the second node being located between the light-emitting element and the first transistor, the third transistor being turned on when a control signal is supplied to a control line, and a storage capacitor coupled between the first node and one electrode of the first transistor or the second node.

In an embodiment, each of the first and second drivers may include a scan driver configured to supply the scan signal to the scan line, a control line driver configured to supply the control signal to the control line, a data driver configured to supply a data signal or a reference voltage to the data line, and a sensor coupled to the sensing line and configured to generate an output signal corresponding to the voltage of the second node.

In an embodiment, the reference voltage may be set to a voltage capable of turning on the first transistor during each sensing period for detecting characteristic information of the first pixels or the second pixels.

In an embodiment, the sensor may supply a precharge voltage that is lower than the reference voltage to the sensing line before the reference voltage is supplied to the data line.

In an embodiment, the controller may include a compensator configured to convert input image data in response to the output signal from the sensor and to supply the converted image data to the data driver.

In an embodiment, the compensator may convert the input image data so as to compensate for the characteristic variation of the first and second pixels.

In an embodiment, the display device may further include a base member located between the first and second displays, and the first and second displays may be located on both sides of the base member so as to overlap each other.

An embodiment of the present disclosure may provide for a driving method of a display device including a first display including first pixels, and a second display including second pixels. The driving method may include displaying an image in the first display while supplying first operating power to enable the first pixels to emit light, to the first display, and detecting characteristic information of the second pixels while supplying second operating power to prevent the second pixels from emitting light, to the second display during at least one period while the image is displayed in the first display. While the characteristic information of the second pixels is detected, the first display may be coupled to the first voltage source of a second power supply and the second display may be coupled to the second voltage source of the second power supply.

In an embodiment, the first operating power may include first power having a high voltage and second power having a low voltage, and the second operating power may include first power having the high voltage and second power having a high voltage.

In an embodiment, the driving method may further include displaying an image in the second display by supplying the first operating power to the second display. Also, the driving method may further include detecting characteristic information of the first pixels by supplying the second operating power to the first display during at least one period while the image is displayed in the second display.

An embodiment of the present disclosure may provide for a driving method of a display device including a first display including first pixels, and a second display including second pixels. The driving method may include displaying an image in the first display, and detecting characteristic information of the second pixels during at least one period when the image is displayed in the first display. Detecting the characteristic information of the second pixels may include supplying a precharge voltage having a first low voltage to sensing lines coupled to the second pixels, supplying a reference voltage having a second low voltage higher than the first low voltage capable of preventing the second pixels from emitting light, to the sensing lines, and detecting the characteristic information of the second pixels by coupling the sensing lines to a sensor.

In an embodiment, first power and second power, which have a potential difference therebetween such that the first and second pixels emit light, may be supplied to the first and second displays, and the second low voltage may be set lower than the voltage of each of the first power and the second power.

DETAILED DESCRIPTION

Figure 1A:
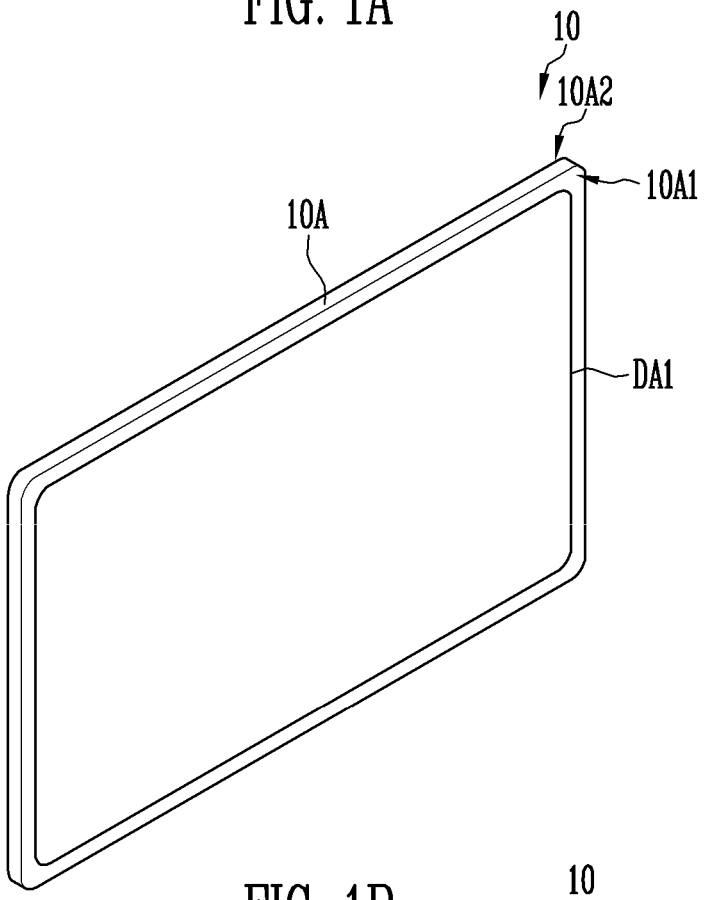
FIG. 1A and FIG. 1B are perspective views schematically illustrating a display device according to an embodiment of the present disclosure.

Because the present disclosure may be suitably changed and may have various embodiments, specific embodiments will be described in detail below with reference to the attached drawings. However, it should be noted that the present disclosure is not limited to the following embodiments, and may be implemented in various forms. Also, in the following description, a singular form may include a plural form as long as it is not specifically mentioned in a sentence.

In the drawings, portions that are not directly related to the present disclosure will be omitted in order to clarify the description of the present disclosure. Also, the sizes and relative sizes of some elements in the drawings may be exaggerated. In the drawings, the same or similar elements are denoted by the same reference numerals even though they are depicted in different drawings, and a repeated description will be omitted.

Figure 1B:
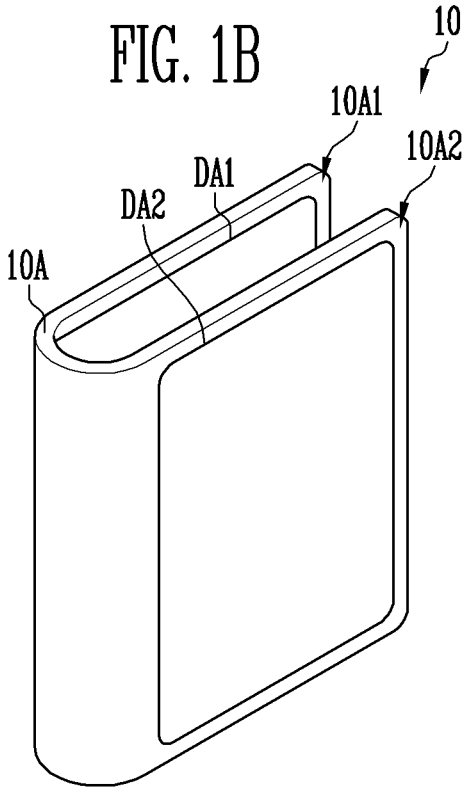

FIG. 1A and FIG. 1B are perspective views schematically illustrating a display device 10 according to an embodiment of the present disclosure. According to an embodiment, FIG. 1A and FIG. 1B disclose a foldable display device, including multiple displays and usable in the state in which it is folded or unfolded. However, the display device 10 according to the present disclosure is not limited to a foldable display device, and the type and structure of the display device 10 may be suitably changed according to an embodiment.

Referring to FIG. 1A and FIG. 1B, the display device 10 according to an embodiment of the present disclosure includes a base member 10A and a first display DA1 and a second display DA2, each of which is located at any one surface of the base member 10A. For example, the first display DA1 and the second display DA2 may be on different (e.g., opposite) surfaces of the base member 10A. For example, the first display DA1 and the second display DA2 may be on both (e.g., opposite) sides of the base member 10A so as to overlap each other by interposing the base member 10A therebetween. However, the positions of the first display DA1 and the second display DA2 may be suitably changed in some embodiments. For example, in another embodiment, the first display DA1 and the second display DA2 may be on the same surface of the base member 10A so as to adjoin each other.

The base member 10A is a base layer (or a base structure) for forming the panel of the display device 10, and may be configured with a single layer or multiple layers. According to an embodiment, the base member 10A may include a rigid or flexible substrate or film, and the material or property thereof is not limited to a specific one. When the display device 10 is a foldable display device, the base member 10A has flexibility in at least one area thereof or includes a hinge structure or the like, whereby the display device 10 may be produced such that it is capable of being folded or unfolded.

The first display DA1 may be on the first surface 10A1 of the base member 10A, and the second display DA2 may be on the second surface 10A2 of the base member 10A. The first surface 10A1 and the second surface 10A2 of the base member 10A may be surfaces facing each other, but are not limited thereto. Also, the second display DA2 may overlap at least one area of the first display DA1. For example, the second display DA2 may have a smaller area than the first display DA1, and may be placed so as to overlap one area of the first display DA1. However, the relative sizes (e.g., the areas) of the first display DA1 and the second display DA2 and/or the relative dispositions thereof may be suitably changed in some embodiments.

In an embodiment, the first display DA1 and the second display DA2 may be driven in different periods. For example, the first display DA1 is driven (e.g. activated to a display mode) in the state in which the display device 10 is unfolded, thereby displaying an image or information corresponding to input image data. The second display DA2 is driven in the state in which the display device 10 is folded, thereby displaying an image or information corresponding to input image data or a set or predetermined image or information corresponding to an idle screen.

The above-described display device 10 includes the first display DA1 and the second display DA2 located on both sides, whereby the display device 10 may be used in the state in which it is folded or unfolded. For example, a large-screen image may be displayed by driving the display device 10 in the state in which it is unfolded so as to expose the first display DA1. Alternatively, an image may be displayed by driving the second display DA2 in the state in which the display device 10 is folded so as to expose the second display DA2, whereby a desired image or information may be displayed without unfolding the display device 10. According to the above-described display device 10, improved usability and portability may be provided.

Figure 2:
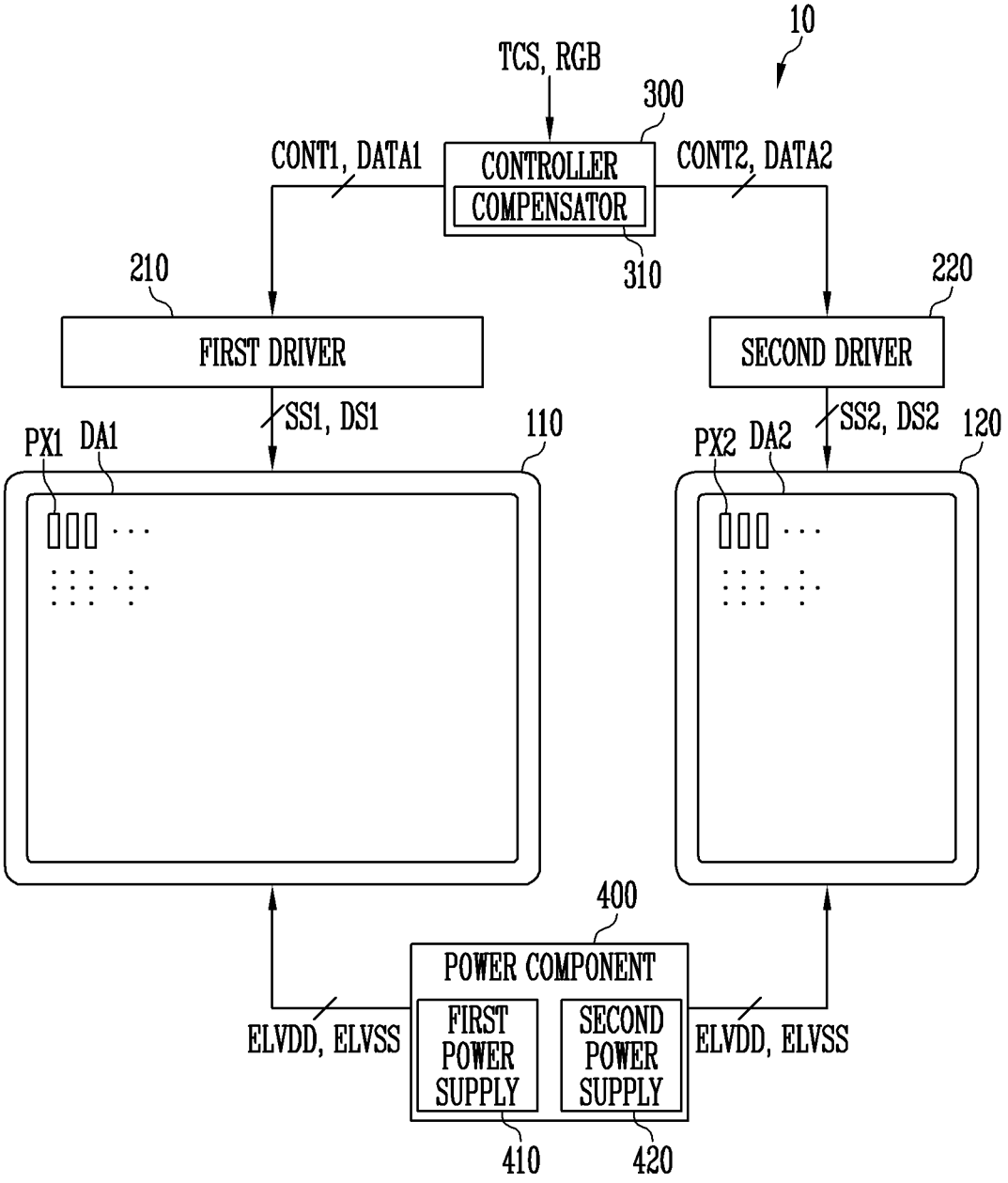
FIG. 2 is a block diagram illustrating a display device according to an embodiment of the present disclosure.

FIG. 2 is a block diagram illustrating a display device 10 according to an embodiment of the present disclosure. According to an embodiment, FIG. 2 discloses an embodiment related to the components of the display device 10 including multiple displays, like the embodiment of FIG. 1A and FIG. 1B.

Referring to FIGS. 1A to 2, the display device 10 according to an embodiment of the present disclosure may include a first display panel 110 and a second display panel 120, which include a first display DA1 and a second display DA2, respectively, a first driver 210 and a second driver 220, configured to drive the first and second display panels 110 and 120, a controller 300 configured to control the first and second drivers 210 and 220, and a power component 400 configured to supply operating power to the first and second display panels 110 and 120.

The first display panel 110 includes the first display DA1 including first pixels PX1. The second display panel 120 includes the second display DA2 including second pixels PX2.

In an embodiment, the first and second display panels 110 and 120 may be combined with each other after they are separately produced. For example, the first and second display panels 110 and 120 may be separately produced. Then, the first and second display panels 110 and 120 are bonded to the base member 10A and combined with each other through the base member 10A, or the second display panel 120 is directly bonded to one surface of the first display panel 110, whereby the first and second display panels 110 and 120 may be combined with each other. In another embodiment, the first and second display panels 110 and 120 may be produced so as to form a single body. For example, the first and second display panels 110 and 120 share a single base member 10A, and each of the first display DA1 and the second display DA2 may be located on any one surface of the base member 10A.

The first and second display panels 110 and 120 may be driven in different periods, or may be individually driven. To this end, the display device 10 may include the first driver (or referred to as a "first panel driver") 210 and the second driver (or referred to as a "second panel driver") 220.

The first driver 210 is for driving the first display DA1 and generates various kinds of driving signals, which are necessary for driving the first pixels PX1. For example, the first driver 210 may include a first scan driver and a first data driver configured to supply respective scan signals (or referred to as "first scan signals SS1") and respective data signals (or referred to as "first data signals DS1") to the first pixels PX1. Also, the first driver 210 may further include at least one of a first emission control driver, a first control line driver, and a first sensor depending on the structure and/or the driving method of the first pixels PX1. For example, when the first pixels PX1 are driven by the respective scan signals, data signals, and control signals and when the characteristics of the first pixels PX1, detected using the control signals, are used to compensate for the characteristic variation of the first pixels PX1, the first driver 210 may further include the first control line driver and the first sensor.

The second driver 220 is for driving the second display DA2 and generates various kinds of driving signals, which are necessary for driving the second pixels PX2. For example, the second driver 220 may include a second scan driver and a second data driver configured to supply respective scan signals (or referred to as "second scan signals SS2") and respective data signals (or referred to as "second data signals DS2") to the second pixels PX2. Also, the second driver 220 may further include at least one of a second emission control driver, a second control line driver, and a second sensor depending on the structure and/or the driving method of the second pixels PX2. For example, when the second pixels PX2 are driven by the respective scan signals, data signals, and control signals and when the characteristics of the second pixels PX2, detected using the control signals, are used to compensate for the characteristic variation of the second pixels PX2, the second driver 220 may further include the second control line driver and the second sensor.

The first and second drivers 210 and 220 may be separately produced and/or located, or at least one portion of the first driver 210 and at least one portion of the second driver 220 may be integrated and/or located in a single integrated circuit together. Also, the first and second drivers 210 and 220 may be produced and/or located separately from the first and second display panels 110 and 120, respectively, or at least portions of the first and second drivers 210 and 220 may be integrated with the first and second display panels 110 and 120 so as to form a single body. For example, the first driver 210 may be produced separately from the first display panel 110 and electrically coupled to the first display panel 110, or at least one portion of the first driver 210 (e.g., the first scan driver and the like) may be located or mounted on the first display panel 110 along with the first pixels PX1. Similarly, the second driver 220 may be produced separately from the second display panel 120 and electrically coupled to the second display panel 120, or at least one portion of the second driver 220 (e.g., the second scan driver and the like) may be located or mounted on the second display panel 120 along with the second pixels PX2.

The controller 300 is for controlling the first and second drivers 210 and 220 and generates various kinds of control signals that are necessary for driving the first and second drivers 210 and 220. For example, the controller 300 may generate a first control signal CONT1 and a second control signal CONT2 using timing signals TCS (e.g., vertical/horizontal synchronization signals, a main clock signal, and the like) supplied from a host processor or the like and supply the first and second control signals CONT1 and CONT2 to the first and second drivers 210 and 220, respectively.

The first control signal CONT1 may include various suitable kinds of control signals for controlling the first driver 210. For example, the first control signal CONT1 may include a first scan control signal (e.g., a first gate sampling pulse, a first gate sampling clock, and the like) for controlling the first scan driver, and a first data control signal (e.g., a first source sampling pulse, a first source sampling clock, a first source output enable signal, and the like) for controlling the first data driver. Additionally, the first control signal CONT1 may further include various suitable kinds of control signals necessary for driving the first driver 210.

The second control signal CONT2 may include various suitable kinds of control signals for controlling the second driver 220. For example, the second control signal CONT2 may include a second scan control signal (e.g., a second gate sampling pulse, a second gate sampling clock, and the like) for controlling the second scan driver, and a second data control signal (e.g., a second source sampling pulse, a second source sampling clock, a second source output enable signal, and the like) for controlling the second data driver. Additionally, the second control signal CONT2 may further include various suitable kinds of control signals necessary for driving the second driver 220.

Also, the controller 300 rearranges input image data RGB supplied from the host processor or the like and supplies the same to the first and second drivers 210 and 220. For example, the controller 300 may determine the display panel on which an image corresponding to the input image data RGB is to be displayed, among the first and second display panels 110 and 120, depending on the state or driving mode of the display device 10, rearrange the input image data RGB depending on the determination, and supply the rearranged input image data RGB to the first or second driver 210 or 220. For example, when the display device 10 is driven in the state in which it is unfolded, the controller 300 may generate first image data DATA1 by rearranging the input image data RGB and supply the first image data DATA1 to the first driver 210. Accordingly, the respective first data signals DS1 corresponding to the first image data DATA1 may be supplied to the first pixels PX1. Similarly, when the display device 10 is driven in the state in which it is folded, the controller 300 may generate second image data DATA2 by rearranging the input image data RGB and supply the second image data DATA2 to the second driver 220. Accordingly, the respective second data signals DS2 corresponding to the second image data DATA2 may be supplied to the second pixels PX2.

In an embodiment, the controller 300 may further include a compensator 310 configured to compensate for the characteristic variation of the first and second pixels PX1 and PX2. For example, when the display device 10 compensates for the characteristic variation of the first and second pixels PX1 and PX2 (the characteristic variation between the first pixels PX1, the characteristic variation between the second pixels PX2, and/or the characteristic variation between the first pixels PX1 and the second pixels PX2) in a manner of external compensation using data compensation and the like, the controller 300 may further include the compensator 310 configured to generate first image data DATA1 and second image data DATA2 by changing the input image data RGB so as to compensate for the characteristic variation of the first and second pixels PX1 and PX2.

Hereinafter, when a specific pixel, among the first and second pixels PX1 and PX2, is indicated or when the pixels of a specific display are indicated, the specific pixel or pixels may be referred to as "a first pixel PX1", "first pixels PX1", "a second pixel PX2", or "second pixels PX2". Also, when at least one pixel, among the first and second pixels PX1 and PX2, is indicated or when the first and second pixels PX1 and PX2 are collectively indicated, the at least one pixel or the pixels may be referred to as "a pixel PX" or "pixels PX".

The power component 400 is for supplying the operating power of the first and second display panels 110 and 120, and may supply, for example, first power ELVDD and second power ELVSS to the first and second displays DA1 and DA2. Based on the emission period of each pixel PX, the first power ELVDD may be high-potential pixel power for the pixel PX, and the second power ELVSS may be low-potential pixel power for the pixel PX. For example, the first power ELVDD and the second power ELVSS may have a potential difference therebetween that enables the pixel PX to emit light during at least the emission period of the corresponding pixel PX.

The power component 400 may generate first power ELVDD and second power ELVSS using input power and supply the first power ELVDD and the second power ELVSS to the first and second displays DA1 and DA2. To this end, the power component 400 may include a first power supply 410 for generating first power ELVDD and supplying the same to the first and second displays DA1 and DA2 and a second power supply 420 for generating second power ELVSS and supplying the same to the first and second displays DA1 and DA2.

Figure 3:
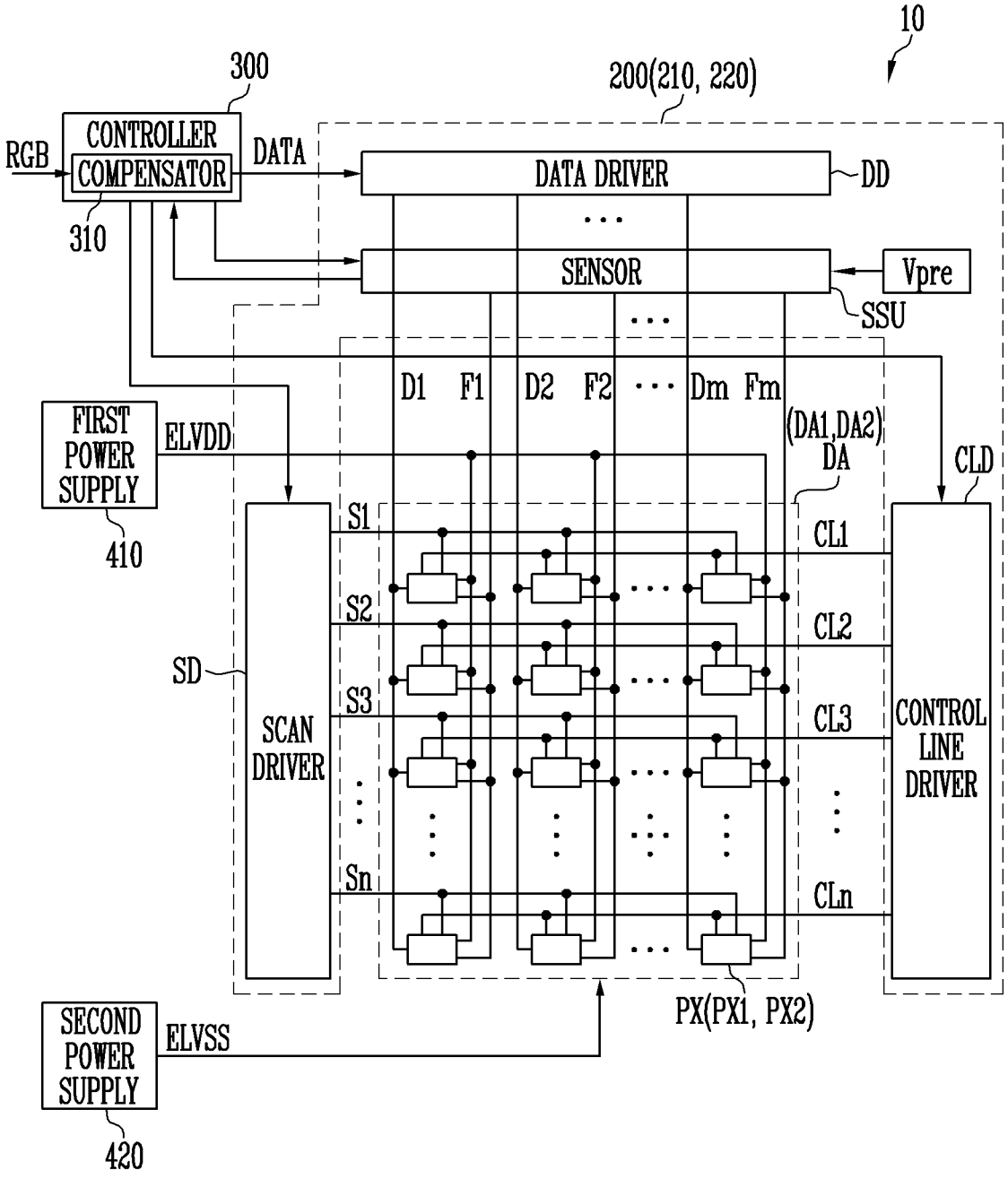
FIG. 3 is a block diagram illustrating an embodiment of the respective displays and drivers for driving the respective displays illustrated in FIG. 2.

FIG. 3 is a block diagram illustrating an embodiment of the respective displays DA illustrated in FIG. 2 and the drivers 200 for driving the same. For example, the display DA of FIG. 3 may be any one of the first and second displays DA1 and DA2 of FIG. 2, and the driver 200 of FIG. 3 may be any one of the first and second drivers 210 and 220 of FIG. 2. For example, the display DA and the driver 200 in FIG. 3 may be the first display DA1 and the first driver 210, respectively, or may be the second display DA2 and the second driver 220, respectively.

According to an embodiment, the sizes (areas and the like) and/or the number of pixels PX of the first display DA1 may be identical to or different from those of the second display DA2, and the configuration and/or arrangement of each pixel PX provided in the first display DA1 may be identical to or different from those of each pixel PX provided in the second display DA2. Similarly, the first and second drivers 210 and 220 may have the same structure or different structures. For example, the first and second pixels PX1 and PX2 may have the same structure, and the first and second drivers 210 and 220 may have the same structure and include respective sensors SSU (as shown in FIG. 3) for detecting the characteristics of the first pixels PX1 and the second pixels PX2.

Referring to FIG. 2 and FIG. 3, the display device 10 according to an embodiment of the present disclosure may include respective displays DA and respective drivers 200 for driving the displays DA. For example, when the display device 10 includes the first display DA1 and the second display DA2, which are individually or alternately driven, the display device 10 may include the first driver 210 for driving the first display DA1 and the second driver 220 for driving the second display DA2. According to an embodiment, the first driver 210 and the second driver 220 may be individually placed and/or configured, or may be placed and/or configured in such a way that at least portions thereof are integrated with each other.

Each of the displays DA includes scan lines S1 to Sn, control lines CL1 to CLn, data lines D1 to Dm, and multiple pixels coupled to the scan lines S1 to Sn, the control lines CL1 to CLn, and the data lines D1 to Dm. For example, the first display DA1 may include multiple first pixels PX1, each of which is coupled to any one scan line, control line, and data line, and the second display DA2 may include multiple second pixels PX2, each of which is coupled to any one scan line, control line, and data line. When an embodiment of the present disclosure is described, "coupling" may comprehensively mean "coupling" in physical and/or electrical aspects.

Each of the pixels PX includes a light-emitting element (e.g., an organic light-emitting diode) and a pixel circuit for driving the same. Each of these pixels PX emits light with luminance corresponding to the data signal of each frame during a display period. Accordingly, a set or predetermined image may be displayed in the display DA. Meanwhile, the pixels PX are coupled to sensing lines F1 to Fm during a sensing period, and the characteristics of the respective pixels PX are detected through the sensing lines F1 to Fm.

Each of the drivers 200 may include a scan driver SD, a control line driver CLD, a data driver DD, and a sensor SSU (or referred to as a "sensing circuit"). The scan driver SD, the control line driver CLD, the data driver DD and/or the sensor SSU may be integrated into a single driver IC, or may be individually and/or separately located.

The scan driver SD supplies respective scan signals to the scan lines S1 to Sn while being controlled by the controller 300. For example, the scan driver SD may sequentially supply scan signals to the scan lines S1 to Sn during each frame period of a display period and a sensing period.

The control line driver CLD supplies respective control signals to the control lines CL1 to CLn while being controlled by the controller 300. For example, the control line driver CLD may sequentially supply control signals to the control lines CL1 to CLn such that a single horizontal line is selected during each frame period of a sensing period. Meanwhile, the control line driver CLD may supply a control signal having a gate-off voltage to the control lines CL1 to CLn during a display period.

The data driver DD supplies respective data signals to the data lines D1 to Dm while being controlled by the controller 300. For example, during a display period, the data driver DD is supplied with image data DATA converted by the controller 300, generates data signals corresponding to the image data DATA, and outputs the data signals to the data lines D1 to Dm. Meanwhile, the data driver DD may supply a set or predetermined reference voltage to the data lines D1 to Dm during a sensing period.

The sensor SSU senses the characteristic information of the respective pixels PX through the sensing lines F1 to Fm during a sensing period while being controlled by the controller 300, and supplies the characteristic information to the controller 300 (e.g., a compensator 310). For example, the sensor SSU may sense the degradation information of the light-emitting element and/or the characteristic information of the driving transistor of each of the pixels PX through the sensing lines F1 to Fm during each sensing period and transmit the sensed information to the compensator 310. For example, the sensor SSU may sense the voltage of the second node of each of the pixels PX, coupled to the sensing lines F1 to Fm, through the sensing lines F1 to Fm during each sensing period, generate an output signal corresponding to the voltage of the second node, and transmit the output signal to the compensator 310.

The controller 300 controls the operations of the scan driver SD, the control line driver CLD, the data driver DD, and the sensor SSU by supplying the respective control signals to the scan driver SD, the control line driver CLD, the data driver DD, and the sensor SSU. Also, the controller 300 converts input image data RGB in response to the characteristic information of the pixels PX, which is supplied by the sensor SSU, and supplies the converted image data DATA to the respective drivers 200. For example, the compensator 310 may convert the input image data RGB in response to the signal output from the sensor SSU so as to compensate for the characteristic variation of the pixels PX, and may then supply the converted image data DATA to the respective data drivers DD.

The first power supply 410 supplies first power ELVDD to the pixels PX of the respective displays DA. For example, the first power supply 410 may supply first power ELVDD at a fixed level (e.g., a high level) to the pixels PX during a display period and a sensing period.

The second power supply 420 supplies second power ELVSS to the pixels PX of the respective displays DA. In an embodiment, the second power supply 420 may supply the second power ELVSS at a first level (e.g., a ground level or a low level) to the pixels PX during the display period of each of the displays DA and supply the second power ELVSS at a second level (e.g., a high level) to the pixels PX during the sensing period of each of the displays DA. In another embodiment, the second power supply 420 may supply the second power ELVSS at a fixed level (e.g., a ground level or a low level) during the display period and sensing period of each of the displays DA. That is, the display device 10 may be driven by varying the voltage level of the second power ELVSS according to an embodiment.

Figure 4:
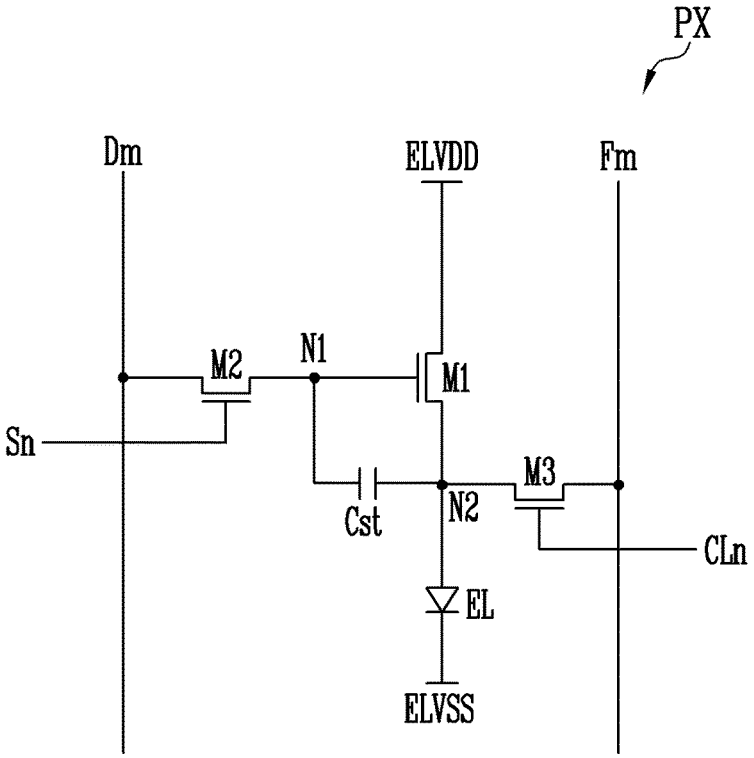
FIG. 4 is a circuit diagram illustrating a pixel according to an embodiment of the present disclosure and illustrates, for example, an embodiment of a pixel that may be provided in the display of FIG. 3.

FIG. 4 is a circuit diagram illustrating a pixel PX according to an embodiment of the present disclosure and illustrates, for example, an embodiment of a pixel PX that may be provided in the display DA of FIG. 3. For example, the pixel PX of FIG. 4 may be a first pixel PX1 provided in the first display DA1 or a second pixel PX2 provided in the second display DA2. According to an embodiment, the first pixel PX1 and the second pixel PX2 may be configured so as to be identical to each other, but the configurations thereof are not limited thereto. For the convenience of description, FIG. 4 illustrates the pixel PX coupled to the n-th scan line (hereinafter, referred to as the "scan line Sn" and n is a natural number), the n-th control line (hereinafter, referred to as the "control line CLn"), the m-th data line (hereinafter, referred to as the "data line Dm"), and the m-th sensing line (hereinafter, referred to as the "sensing line Fm") of each of the displays DA.

Referring to FIG. 3 and FIG. 4, the pixel PX according to an embodiment of the present disclosure includes a light-emitting element EL, first to third transistors M1 to M3, and a storage capacitor Cst. According to an embodiment, each of the first to third transistors M1 to M3 is illustrated as being an N-type (N-channel) transistor in FIG. 4, but the type thereof may be suitably changed according to an embodiment. For example, in another embodiment, at least one of the first to third transistors M1 to M3 may be changed to a P-type (P-channel) transistor.

The light-emitting element EL is coupled between the power sources of first power ELVDD and second power ELVSS. The light-emitting element EL emits light with luminance corresponding to a driving current when the driving current is supplied from the first transistor M1. According to an embodiment, the light-emitting element EL may be an organic light-emitting diode (OLED) including an organic light-emitting layer, but the light-emitting element EL is not limited thereto. For example, in another embodiment, very small inorganic light-emitting elements having a nanoscale to microscale size may form the light source of each pixel PX.

The first transistor M1 is coupled between the power source of the first power ELVDD and the light-emitting element EL, and the gate electrode thereof is coupled to a first node N1. The first transistor M1 controls the driving current supplied to the light-emitting element EL in response to the voltage of the first node N1.

The second transistor M2 is coupled between the data line Dm and the first node N1, and the gate electrode thereof is coupled to the scan line Sn. The second transistor M2 is turned on when a scan signal having a gate-on voltage (e.g., a high voltage) is supplied to the scan line Sn. Here, the scan signal having the gate-on voltage may be supplied at least once in each frame period of a display period and at least once in a set or predetermined frame period of a sensing period (e.g., a set or predetermined sensing frame period for detecting the characteristic information of the pixels PX of a corresponding horizontal line). Hereinafter, a "scan signal having a gate-on voltage" may also be referred to as a "scan signal". When the second transistor M2 is turned on, the voltage of the data line Dm (e.g., the voltage of the data signal or a reference voltage) is transmitted to the first node N1.

The third transistor M3 is coupled between a second node N2 and the sensing line Fm, and the gate electrode thereof is coupled to the control line CLn. The third transistor M3 is turned on when a control signal having a gate-on voltage (e.g., a high voltage) is supplied to the control line CLn. Here, the control signal having the gate-on voltage may be supplied during a set or predetermined frame period of a sensing period (e.g., a set or predetermined sensing frame period for detecting the characteristic information of the pixels PX of a corresponding horizontal line). Here, a "control signal having a gate-on voltage" may also be referred to as a "control signal". When the third transistor M3 is turned on, the second node N2 is coupled to the sensing line Fm.

In an embodiment, each of the first to third transistors M1 to M3 may be an N-type oxide thin-film transistor (that is, a thin-film transistor of which the active layer is an oxide semiconductor). In this case, characteristics that are more improved than those of a thin-film transistor using amorphous silicon (a-Si) or polycrystalline silicon (Poly-Si) may be provided, and a crystallization process for crystalizing the active layer is not required, unlike a Low-Temperature Poly-Silicon (LTPS) thin-film transistor.

However, the type of each of the first to third transistors M1 to M3 may be suitably changed according to an embodiment. For example, in another embodiment, at least one of the first to third transistors M1 to M3 may be a P-type or N-type LTPS thin-film transistor or any of other types of transistors.

The storage capacitor Cst is coupled between one electrode of the first transistor M1 and the first node N1. For example, the storage capacitor Cst may be coupled between the first node N1 and the second node N2. The storage capacitor Cst is charged with a voltage corresponding to the voltage of the first node N1.

The above-described pixel PX is supplied with a data signal from the data line Dm when a scan signal is supplied to the scan line Sn during each frame period of a display period, and emits light with the luminance corresponding to the data signal.

Specifically, the pixel PX is supplied with a scan signal through the scan line Sn in each frame period of a display period (e.g., a horizontal period in which a corresponding horizontal line is selected during the frame period). Accordingly, the second transistor M2 is turned on. Also, the data signal of each frame is supplied to the data line Dm of the pixel PX so as to be synchronized with the scan signal. Accordingly, when the second transistor M2 is turned on through the scan signal, the data signal of each frame is transmitted to the first node N1. Accordingly, the storage capacitor Cst is charged with the voltage corresponding to the data signal. When a data signal having a voltage capable of turning on the first transistor M1 is supplied to the first node N1, the first transistor M1 is turned on, whereby the driving current corresponding to the voltage of the first node N1 is supplied to the light-emitting element EL. Accordingly, the light-emitting element EL emits light with luminance corresponding to the data signal.

Meanwhile, when it is intended to detect the degradation information of the light-emitting element EL during one period of a display period, a control signal is supplied to the control line CLn during the corresponding period, whereby the third transistor M3 may be turned on. For example, when it is intended to detect the degradation information of the light-emitting elements of the pixels PX in any one horizontal line during each frame period of a display period, a control signal is supplied to the control line CLn coupled to the pixels PX during at least one period in the emission period of the pixels PX, whereby the third transistors M3 may be turned on. In this case, the voltage applied to the anode electrode of the light-emitting element EL in each of the pixels PX may be sensed through the sensing line Fm.

Meanwhile, during a set or predetermined sensing frame period corresponding to the pixel PX within a set or predetermined sensing period, which does not overlap the display period, the characteristic information of the pixel PX (e.g., information about the threshold voltage of the first transistor M1) may be sensed through the sensing line Fm. The process of sensing the characteristic information of the pixel PX during a sensing period will be described in more detail later.

Figure 5:
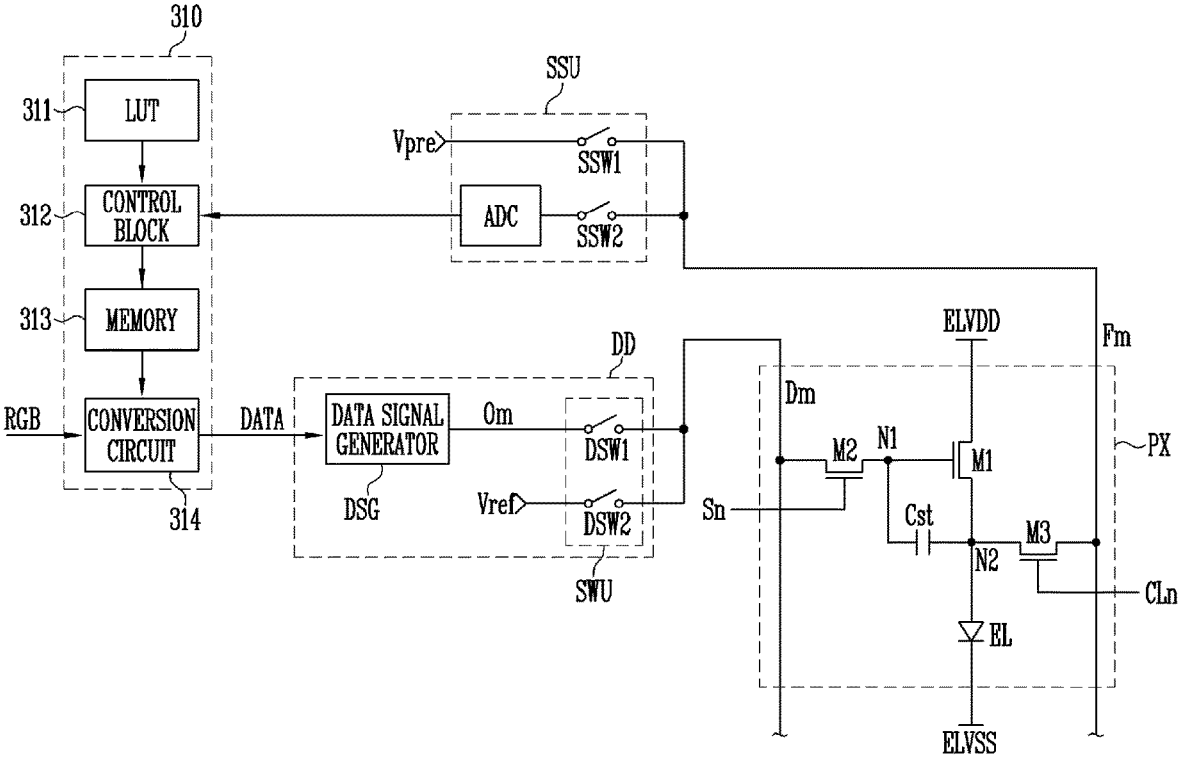
FIG. 5 is a block diagram illustrating an embodiment of the data driver, the sensor, and the compensator illustrated in FIG. 3.

FIG. 5 is a block diagram illustrating an embodiment of the data driver DD, the sensor SSU, and the compensator 310 illustrated in FIG. 3. For the convenience of description, FIG. 5 illustrates the configurations of the data driver DD and the sensor SSU based on the channel coupled to the pixel PX of FIG. 4.

Referring to FIGS. 3 to 5, the sensor SSU includes a first sensing switch SSW1, coupled between each sensing line Fm and the source of a precharge voltage Vpre, a second sensing switch SSW2, coupled between the sensing line Fm and the compensator 310, and an analog-to-digital converter (hereinafter, referred to as a "ADC"), coupled between the second sensing switch SSW2 and the compensator 310.

The first sensing switch SSW1 is turned on during a first period of a sensing period in which the characteristic information of the pixel PX is sensed via the sensing line Fm.

The second sensing switch SSW2 is turned on during a second period of the sensing period. The second sensing switch SSW2 is not turned on simultaneously or concurrently with the first sensing switch SSW1, and may be turned on after the turn-on period of the first sensing switch SSW1. That is, the second period may be a period following each first period.

Meanwhile, according to an embodiment, the second sensing switch SSW2 may be turned on during one period in the display period. For example, while the pixels PX of a set or predetermined horizontal line emit light in response to data signals in a display period, a control signal is supplied to the control line CLn coupled to the pixels PX, and the second sensing switch SSW2 corresponding to each sensing line Fm may be turned on. In this case, the voltage of the second node N2, applied to the anode electrode of the light-emitting element EL of each of the pixels PX, (hereinafter, referred to as an "anode voltage") is supplied to each analog to digital converter (ADC), whereby the anode voltage is sensed by the sensor SSU.

As the light-emitting element EL is increasingly degraded, the resistance value of the light-emitting element EL is changed, and the anode voltage is also changed. Therefore, the degradation information pertaining to the light-emitting element EL may be extracted from the anode voltage. According to an embodiment, the anode voltage may be used to convert input image data RGB in order to compensate for the variation of each pixel PX.

The ADC converts the anode voltage of the light-emitting element EL, which is supplied through the second sensing switch SSW2 while the degradation information of the light-emitting element EL is sensed in a display period, into a first digital value. Also, the ADC converts the voltage corresponding to the threshold voltage of the first transistor M1, which is supplied through the second sensing switch SSW2 during a sensing period in which information about the threshold voltage of the first transistor M1 of each pixel PX is sensed, into a digital value (hereinafter, referred to as a "second digital value").

That is, the ADC senses the anode voltage of the light-emitting element EL and/or the threshold voltage of the first transistor M1 through each sensing line Fm, converts the same into the first digital value and the second digital value, and outputs the first digital value and the second digital value.

The data driver DD includes a data signal generator DSG and a switch component SWU coupled between each output line Om of the data signal generator DSG and the data line Dm corresponding thereto. Meanwhile, FIG. 5 illustrates an embedment in which the switch component SWU is included in the data driver DD, but the present disclosure is not limited thereto. For example, in another embodiment, the switch component SWU may be located and/or placed so as to be separate from the data driver DD.

The data signal generator DSG includes multiple channels corresponding to the respective data lines D1 to Dm of the display DA. The data signal generator DSG generates respective data signals in response to the image data DATA supplied from the compensator 310.

The switch component SWU includes a first data switch DSW1, coupled between the data signal generator DSG and the data line Dm, and a second data switch DSW2, coupled between the data line Dm and the source of a reference voltage Vref.

The first data switch DSW1 is coupled between the output line Om corresponding to each channel of the data signal generator DSG and the data line Dm corresponding to the output line Om. The first data switch DSW1 is turned on when each data signal generated in the data signal generator DSG is supplied to each pixel PX. For example, the first data switch DSW1 may maintain a turn-on state during a display period in which each display DA displays a set or predetermined image.

The second data switch DSW2 is turned on during one period in the sensing period in which the characteristic information of each pixel PX is sensed through each sensing line Fm. According to an embodiment, the sensing period may be a period during which information about the threshold voltage of the first transistor M1 in each pixel PX is sensed. For example, the second data switch DSW2 may be turned on during one period in the sensing period for sensing information about the threshold voltage of the first transistor M1 in each pixel PX.

The compensator 310 includes a lookup table (referred to as a "LUT") 311, a control block 312, memory 313, and a conversion circuit 314.

The lookup table 311 stores the reference value of the voltage of the light-emitting element EL relative to the current thereof. The reference value is used to detect and compensate for the degradation of the light-emitting element EL, and the lookup table 311 may be omitted in an embodiment in which the degradation of the light-emitting element EL is not compensated for.

The control block 312 extracts the degradation information of the light-emitting element EL, corresponding to the first digital value provided from the sensor SSU, by referring to the lookup table 311 and stores the same in the memory 313. Also, the control block 312 stores the second digital value provided from the sensor SSU in the memory 313.

The memory 313 stores the characteristic information detected from each pixel PX (e.g., the degradation information of the light-emitting element EL and/or information about the threshold voltage of the first transistor M1). For example, the memory 313 may store the degradation information of the light-emitting element EL, corresponding to the first digital value converted from the anode voltage detected from each pixel PX, and the second digital value corresponding to the threshold voltage of the first transistor M1 of each pixel PX.

The conversion circuit 314 converts the input image data RGB using the characteristic information of each pixel PX, which is stored in the memory 313, and outputs the converted image data DATA to the data driver DD. For example, the conversion circuit 314 converts the input image data RGB so as to compensate for the degradation of the light-emitting element EL and/or the variation in the threshold voltage of the first transistor M1 using the degradation information of the light-emitting element EL and/or the information about the threshold voltage of the first transistor M1 and outputs the converted image data DATA (or referred to as "compensated data").

The image data DATA converted by the conversion circuit 314 is supplied to the data driver DD. Accordingly, the data driver DD generates respective data signals corresponding to the converted image data DATA and supplies the respective data signals to the pixels PX through the respective data lines Dm. Accordingly, the display DA may display an image of uniform luminance regardless of the characteristic variation of the pixels PX (e.g., the degradation of the light-emitting element EL and/or the variation in the threshold voltage of the first transistor M1).

Figure 6:
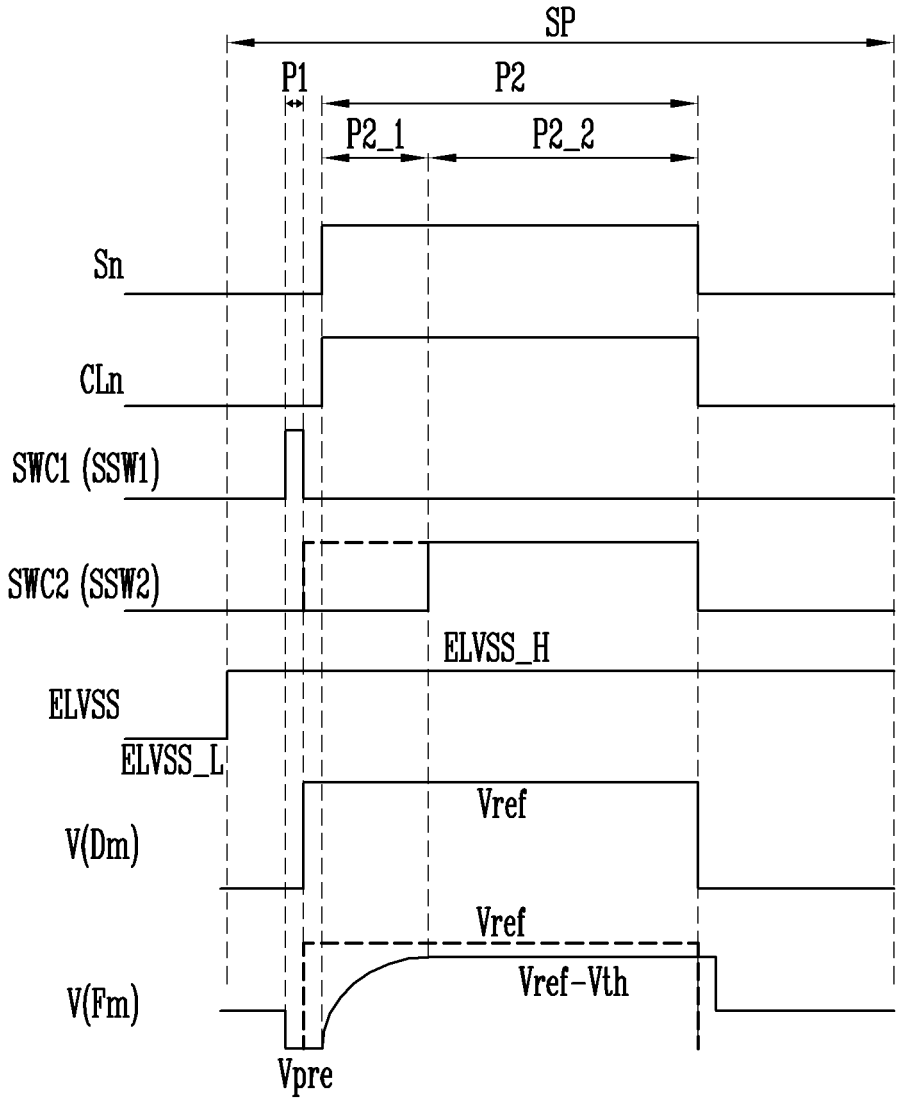
FIG. 6 is a waveform diagram illustrating a driving method of a display device according to an embodiment of the present disclosure and illustrates, for example, an embodiment of the method of sensing the characteristic information of each pixel during a sensing period.

FIG. 6 is a waveform diagram illustrating a driving method of a display device 10 according to an embodiment of the present disclosure and illustrates, for example, a method for sensing the characteristic information of each pixel PX during a sensing period SP. In FIG. 6, for the convenience of description, a method for sensing the characteristic information of a pixel PX is illustrated based on any one pixel PX. For example, the sensing period SP in FIG. 6 may be a period for sensing the characteristic information of the pixels PX of a horizontal line on which the corresponding pixel PX is located.

Referring to FIG. 5 and FIG. 6, the voltage level of the second power ELVSS is raised to a set or predetermined high voltage ELVSS_H during a sensing period SP. For example, the second power ELVSS may be supplied as a low voltage ELVSS_L (e.g., a ground voltage), the voltage level of which enables the light-emitting element EL to emit light, during a period excluding the sensing period SP (e.g., during at least a display period), and may be supplied as a high voltage ELVSS_H, the voltage level of which prevents or blocks the light-emitting element EL from emitting light, in the sensing period SP. According to an embodiment, the high voltage ELVSS_H of the second power ELVSS may have a voltage level that is equal to or higher than the voltage acquired by subtracting the threshold voltage of the light-emitting element EL from the voltage applied to the anode electrode of the light-emitting element EL (that is, the anode voltage) during the sensing period. For example, the high voltage ELVSS_H may be a voltage that is higher than the voltage applied to the anode electrode of the light-emitting element EL during the sensing period SP. Accordingly, the pixel PX may be prevented or blocked from emitting light during the sensing period SP.

During the first period P1, corresponding to the earlier period in the sensing period SP, a first switch control signal SWC1, capable of turning on the first sensing switch SSW1, is supplied to the first sensing switch SSW1. For example, during the first period P1, the first switch control signal SWC1 having a gate-on voltage (e.g., a high voltage) may be supplied to the first sensing switch SSW1. Hereinafter, the "first switch control signal SWC1 having a gate-on voltage" is referred to as a "first switch control signal SWC1".

Accordingly, during the first period P1, the first sensing switch SSW1 is turned on, and the precharge voltage Vpre is transmitted to the respective sensing lines Fm. Accordingly, the voltage V(Fm) of the sensing line Fm is initialized to the precharge voltage Vpre. The precharge voltage Vpre may be a voltage that is lower than the reference voltage Vref such that the difference therebetween is equal to or greater than the threshold voltage Vth of the first transistor M1. For example, the precharge voltage Vpre and the reference voltage Vref may be supplied such that the difference therebetween enables the first transistor M1 to be turned on during at least one period in the sensing period SP. In an embodiment, the precharge voltage Vpre may be a set or predetermined low voltage (e.g., a ground voltage), but the precharge voltage Vpre is not limited thereto. Also, the reference voltage Vref may be a voltage that is capable of turning on the first transistor M1 (e.g., a high voltage at a set or predetermined level) during each sensing period for detecting the characteristic information of the pixels PX.

According to an embodiment, in the remaining period excluding the first period P1, a first switch control signal SWC1 for turning off the first sensing switch SSW1 is supplied to the first sensing switch SSW1. For example, in the remaining period excluding the first period P1 from the sensing period SP, the first switch control signal SWC1 having a gate-off voltage (e.g., a low voltage) may be supplied to the first sensing switch SSW1. Accordingly, during the remaining period, the first sensing switch SSW1 may maintain a turn-off state.

Meanwhile, the reference voltage Vref may be supplied to the data line Dm during one period in the sensing period SP. The reference voltage Vref may have a voltage level capable of turning on the first transistor M1.

For example, a switch control signal for turning on the second data switch DSW2 (referred to as a "data switch control signal") may be supplied to the second data switch DSW2 during a set or predetermined time since the first period P1 ends. For example, a switch control signal having a gate-on voltage (e.g., a high voltage) may be supplied to the second data switch DSW2 during a set or predetermined time since the first period P1 ends. According to an embodiment, the second data switch DSW2 may maintain a turn-on state during the time that is sufficient to charge the respective data lines Dm with the reference voltage Vref. Accordingly, the reference voltage Vref is transmitted to the data line Dm, whereby the voltage V(Dm) of the data line Dm may be changed to the reference voltage Vref.

In an embodiment, the second data switch DSW2 may maintain a turn-on state during at least one period (e.g., the earlier period) while a scan signal is being supplied. Accordingly, while the scan signal is being supplied to each pixel PX during the sensing period SP, the reference voltage Vref may be stably supplied to the pixel PX. In an embodiment, the second data switch DSW2 may be controlled by the control signal supplied from the controller 300 to the data driver DD.

Meanwhile, according to an embodiment, the data signal generator DSG itself may generate and/or supply a reference voltage Vref. For example, a set or predetermined grayscale voltage is set as the reference voltage Vref, and the data signal generator DSG may supply the reference voltage Vref to each data line Dm during at least one period of the sensing period SP. In this case, the switch component SWU is omitted, and each output line Om of the data signal generator DSG may be directly coupled to the corresponding data line Dm.

During the second period P2 following the first period P1 in the sensing period, a scan signal and a control signal are supplied to the scan line Sn and the control line CLn, respectively. For example, after a set or predetermined time since the supply of the reference voltage Vref to the data line Dm is started, the supply of the scan signal and the control signal may be started. Accordingly, the second transistor M2 and the third transistor M3 are turned on.

When the second transistor M2 is turned on, the reference voltage Vref is transmitted to the first node N1, whereby the first transistor M1 is turned on. Here, the storage capacitor Cst is charged with a voltage capable of turning on the first transistor M1. Meanwhile, the voltage of the second power ELVSS is maintained at a high voltage ELVSS_H during the sensing period SP, whereby the light-emitting element EL may maintain a non-emissive state even though the first transistor M1 is turned on.

When the third transistor M3 is turned on, the second node N2 is coupled to the sensing line Fm. Accordingly, the voltage of the second node N2 is transmitted to the sensing line Fm.

In an embodiment, in the earlier period of the period during which the scan signal and the control signal are supplied (hereinafter, referred to as a "first subperiod P2_1"), the first and second switch control signals SWC1 and SWC2 (e.g., the first and second switch control signals SWC1 and SWC2 having a gate-off voltage) for turning off the first and second sensing switches SSW1 and SSW2 may be supplied to the first and second sensing switches SSW1 and SSW2. Accordingly, during the first subperiod P2_1, the second node N2 may be floated.

After the sensing line Fm is charged with the precharge voltage Vpre, the sensing line Fm is coupled to the second node N2 through the third transistor M3, and the reference voltage Vref is supplied to the first node N1, whereby the first transistor M1 is turned on during the first subperiod P2_1. Accordingly, the voltage of the second node N2 is steadily increased, and when the voltage of the second node N2 becomes lower than the reference voltage Vref by the threshold voltage Vth of the first transistor M1, the first transistor M1 is turned off. That is, during the first subperiod P2_1, the first transistor M1 is turned on, and may then be turned off after the voltage difference between the gate electrode and the source electrode thereof becomes equal to the threshold voltage Vth. Accordingly, during the first subperiod P2_1, the voltage V(Fm) of the sensing line Fm is changed from the precharge voltage Vpre to the voltage (Vref−Vth) reduced by the threshold voltage Vth of the first transistor M1 from the reference voltage Vref. After the first transistor M1 is turned off, the voltage of the second node N2 is maintained at the voltage (Vref−Vth) reduced by the threshold voltage Vth of the first transistor M1 from the reference voltage Vref.

During the second subperiod P2_2 following the first subperiod P2_1 in the second period P2, a second switch control signal SWC2 for turning on the second sensing switch SSW2 (e.g., a second switch control signal SWC2 having a gate-on voltage (e.g., a high voltage), hereinafter, referred to as a "second switch control signal SWC2") may be supplied to the second sensing switch SSW2. Accordingly, the second sensing switch SSW2 is turned on, whereby the sensing line Fm is coupled to the ADC corresponding to each channel of the sensor SSU during the second subperiod P2_2. Accordingly, the voltage of the second node N2, that is, the voltage (Vref−Vth) corresponding to the difference between the reference voltage Vref and the threshold voltage Vth of the first transistor M1, is transmitted to the ADC, whereby information about the threshold voltage Vth of the first transistor M1 may be detected. Also, the mobility characteristic of the first transistor M1 may be detected in the same manner.

Meanwhile, the turn-on period of the second sensing switch SSW2 may be suitably changed according to an embodiment. For example, in another embodiment, the first sensing switch SSW1 is turned off after it supplies the precharge voltage Vpre to the sensing line Fm during the first period P1, and immediately after the first sensing switch SSW1 is turned off (that is, immediately after the end of the first period P1), the second sensing switch SSW2 may be turned on by supplying the second switch control signal SWC2. The second sensing switch SSW2 may maintain the turn-on state during the second period P2. In this case, the sufficient time for charging the ADC with the voltage applied to the sensing line Fm may be secured.

In an embodiment, when the voltages of the scan signal and the control signal are changed to the gate-off voltage, the voltage of the second switch control signal SWC2 may also be changed to the gate-off voltage. However, the time at which the second switch control signal SWC2 is supplied may be suitably changed as long as the turn-on period of the third transistor M3 overlaps that of the second sensing switch SSW2.

The ADC converts the characteristic information (information about the threshold voltage Vth and the like) of the first transistor M1 into a second digital value and outputs the second digital value to the control block 312. Then, the control block 312 stores the second digital value in the memory 313. The characteristic information of the first transistor M1, stored in the memory 313, may be used when the conversion circuit 314 converts the input image data RGB. For example, the characteristic information of the first transistor M1 may be used to compensate for the characteristic variation of the pixels PX by converting the input image data RGB.

According to the above-described embodiment, the characteristic information of the pixel PX, for example, information about the threshold voltage Vth of the first transistor M1 or the like, is sensed during the sensing period SP, and the sensed information may be used for data compensation. For example, the input image data RGB may be converted so as to compensate for the variation in the threshold voltages Vth of the first transistors M1 provided in the pixels PX, and the converted image data DATA may be output to the data driver DD. Then, the data driver DD supplies data signals corresponding to the converted image data DATA to the pixels PX during each display period. Accordingly, the characteristic variation between the pixels PX is compensated for, and an image having uniform quality may be displayed in each display DA.

Also, according to the above-described embodiment, the voltage of the second power ELVSS may be maintained at a high voltage ELVSS_H, which prevents or blocks each light-emitting element EL from emitting light, during the sensing period SP. Accordingly, the pixels PX may be prevented or blocked from unintentionally emitting light during the sensing period SP.

Figure 7:
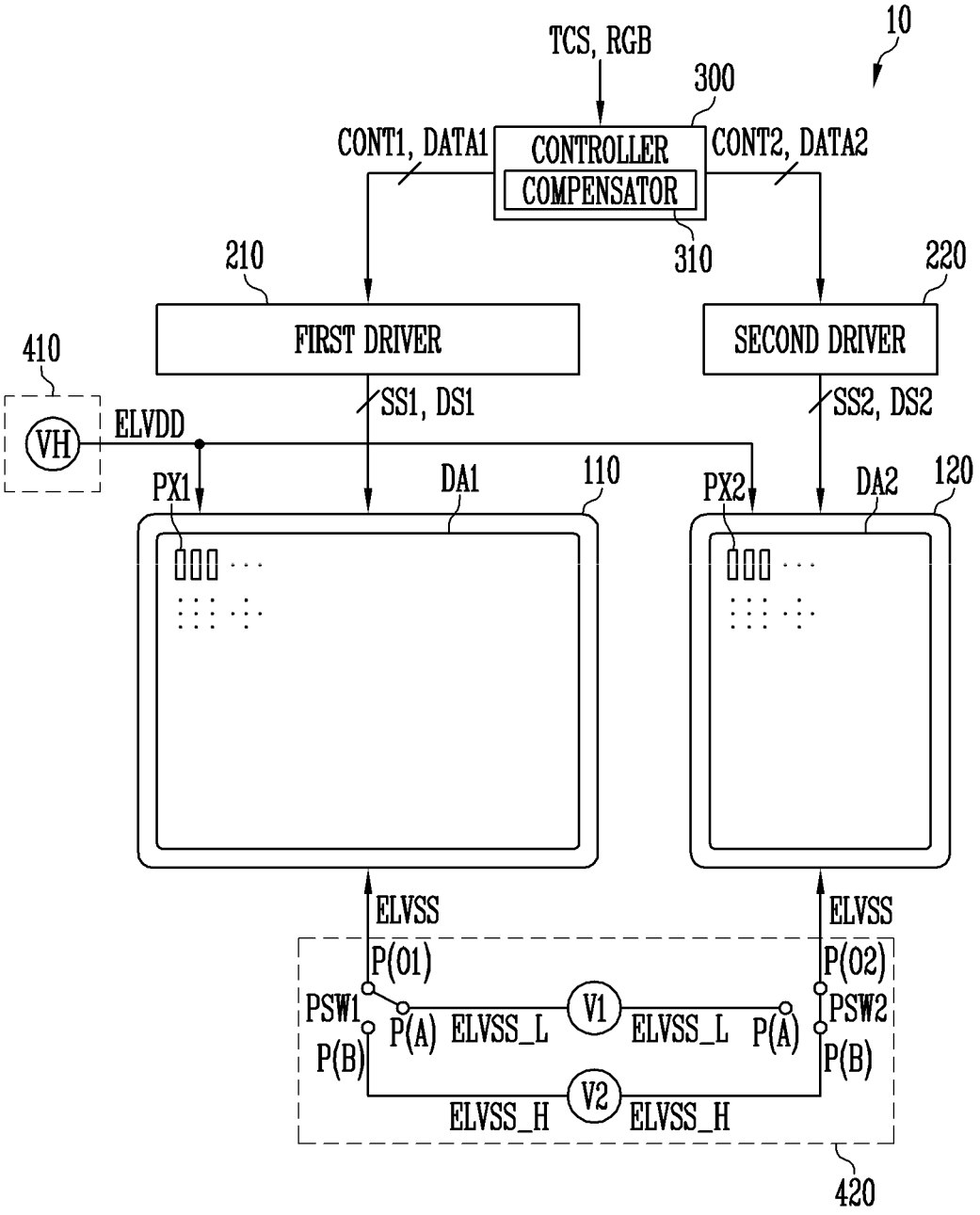
FIG. 7 is a block diagram illustrating a display device according to an embodiment of the present disclosure and illustrates, for example, an embodiment related to the power component illustrated in FIG. 2.

FIG. 7 is a block diagram illustrating a display device 10 according to an embodiment of the present disclosure and illustrates, for example, an embodiment related to the power component 400 illustrated in FIG. 2. When the embodiment of FIG. 7 is described, the same or similar elements in the above-described embodiment are denoted by the same reference numerals, and a detailed description thereof will be omitted.

Referring to FIGS. 2 to 7, the power component 400 according to an embodiment of the present disclosure may include a first power supply 410 for supplying first power ELVDD and a second power supply 420 for supplying second power ELVSS.

The first power supply 410 may supply the first power ELVDD having a fixed voltage to each display DA during the display period and sensing period SP of the display DA. For example, the first power supply 410 has a high voltage source VH for generating first power ELVDD having a high voltage, the level of which is set so as to enable pixels PX to emit light during the respective display periods, and may supply the first power ELVDD having the high voltage to the respective displays DA.

The second power supply 420 may supply the second power ELVSS having a different voltage depending on the display period and sensing period SP of each display DA. For example, the second power supply 420 may supply the second power ELVSS having a low voltage ELVSS_L, which enables the pixels PX to emit light, to each display DA during the display period of the display DA and supply the second power ELVSS having a high voltage ELVSS_H, which prevents or blocks the pixels PX from emitting light, to each display DA during the sensing period SP of the display DA.

According to an embodiment, the second power supply 420 may include multiple voltage sources. For example, the second power supply 420 may include a first voltage source V1 for generating a set or predetermined low voltage ELVSS_L (or referred to as a "first voltage") and a second voltage source V2 for generating a set or predetermined high voltage ELVSS_H (or referred to as a "second voltage"). That is, the first voltage source V1 may generate second power ELVSS having a low voltage ELVSS_L, and the second voltage source V2 may generate second power ELVSS having a high voltage ELVSS_H. The low voltage ELVSS_L of the first voltage source V1 may have a voltage level that enables the first pixels PX1 and the second pixels PX2 to emit light, and the high voltage ELVSS_H of the second voltage source V2 may have a voltage level that prevents or blocks the first pixels PX1 and the second pixels PX2 from emitting light.

Also, the second power supply 420 may further include first and second power switches PSW1 and PSW2, each of which is coupled between any one of the displays DA and the first and second voltage sources V1 and V2. For example, the second power supply 420 may include the first power switch PSW1 (or referred to as a "first switch") coupled between the first display DA1 and the first and second voltage sources V1 and V2 and the second power switch PSW2 (or referred to as a "second switch") coupled between the second display DA2 and the first and second voltage sources V1 and V2.

The first power switch PSW1 may couple the first display DA1 to any one of the first and second voltage sources V1 and V2 depending on the driving mode (e.g., a display mode corresponding to the display period or a sensing mode corresponding to the sensing period SP) of the first display DA1. For example, the first power switch PSW1 may be configured as a 3-port switch that selectively couples the first display DA1 to the first voltage source V1 or the second voltage source V2 depending on whether the first display DA1 is enabled (e.g., whether the first display DA1 is to be driven in the display mode).

During each display period in which the first display DA1 is driven in a display mode, the first power switch PSW1 may couple the first display DA1 to the first voltage source V1. For example, during the display period of the first display DA1, the first power switch PSW1 may couple the output port (hereinafter, referred to as a "first output port P(O1)"), coupled to a second power terminal (or a second power pad) of the first display DA1, to the first input port P(A) coupled to the first voltage source V1. Accordingly, the first display DA1 may be supplied with the second power ELVSS having a low voltage ELVSS_L during the display period.

During each sensing period SP in which the first display DA1 is driven in a sensing mode, the first power switch PSW1 may couple the first display DA1 to the second voltage source V2. For example, during the sensing period of the first display DA1, the first power switch PSW1 may couple the first output port P(O1) to the second input port P(B) coupled to the second voltage source V2. Accordingly, the first display DA1 may be supplied with the second power ELVSS having the high voltage ELVSS_H during the sensing period SP.

The second power switch PSW2 may couple the second display DA2 to any one of the first and second voltage sources V1 and V2 depending on the driving mode (e.g., a display mode corresponding to the display period or a sensing mode corresponding to the sensing period SP) of the second display DA2. For example, the second power switch PSW2 may be configured as a 3-port switch that selectively couples the second display DA2 to the first voltage source V1 or the second voltage source V2 depending on whether the second display DA2 is enabled (e.g., whether the second display DA2 is to be driven in the display mode).

According to an embodiment, during each display period in which the second display DA2 is driven in the display mode, the second power switch PSW2 may couple the second display DA2 to the first voltage source V1. For example, during the display period of the second display DA2, the second power switch PSW2 may couple the output port (hereinafter, referred to as a "second output port P(O2)"), coupled to the second power terminal (or the second power pad) of the second display DA2, to the first input port P(A) coupled to the first voltage source V1. Accordingly, the second display DA2 may be supplied with the second power ELVSS having a low voltage ELVSS_L during the display period.

During each sensing period SP in which the second display DA2 is driven in the sensing mode, the second power switch PSW2 may couple the second display DA2 to the second voltage source V2. For example, during the sensing period of the second display DA2, the second power switch PSW2 may couple the second output port P(O2) to the second input port P(B) coupled to the second voltage source V2. Accordingly, the second display DA2 may be supplied with the second power ELVSS having the high voltage ELVSS_H during the sensing period SP.

Figure 8:
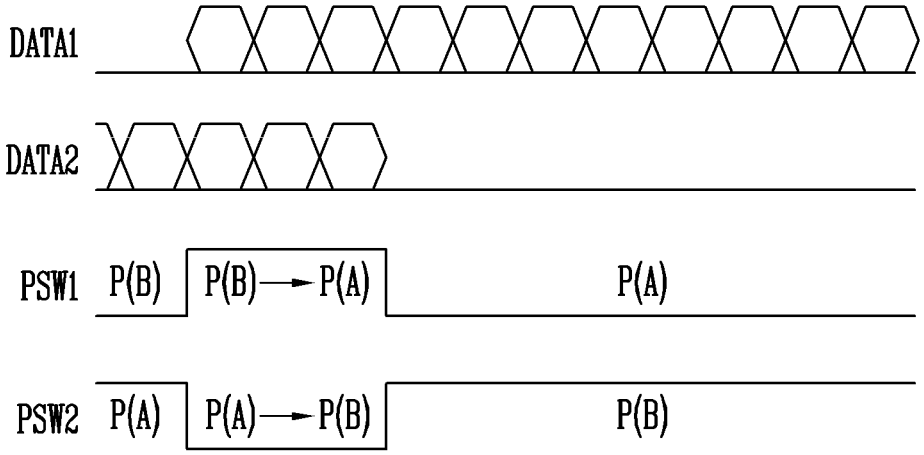
FIG. 8 is a waveform diagram illustrating a driving method of a display device according to an embodiment of the present disclosure and illustrates, for example, an embodiment of a method for supplying second power from the second power supply illustrated in FIG. 7.

FIG. 8 is a waveform diagram illustrating a driving method of the display device 10 according to an embodiment of the present disclosure and illustrates, for example, a method for supplying second power ELVSS by the second power supply 420 illustrated in FIG. 7.

Referring to FIG. 7 and FIG. 8, each of the first and second displays DA1 and DA2 may be driven in a display mode or a sensing mode. Each of the first and second displays DA1 and DA2 may be supplied with the second power ELVSS having a low voltage ELVSS_L during a display period in which the display is driven in the display mode, and may be supplied with the second power ELVSS having a high voltage ELVSS_H during a sensing period SP in which the display is driven in the sensing mode.

For example, the controller 300 may supply first image data DATA1 to the first driver 210 in response to a period in which the first display DA1 displays an image (that is, the display period of the first display DA1). Accordingly, the first driver 210 drives the first pixels PX1 by generating driving signals corresponding to the first image data DATA1, whereby an image corresponding to the first image data DATA1 may be displayed in the first display DA1.

Also, the controller 300 may supply second image data DATA2 to the second driver 220 in response to a period in which the second display DA2 displays an image (that is, the display period of the second display DA2). Accordingly, the second driver 220 drives the second pixels PX2 by generating driving signals corresponding to the second image data DATA2, whereby an image corresponding to the second image data DATA2 may be displayed in the second display DA2.

According to an embodiment, the first display DA1 and the second display DA2 may display images in different times. For example, while the first display DA1 is driven in a display mode, the second display DA2 may be driven in a non-display mode or a sensing mode, and while the second display DA2 is driven in a display mode, the first display DA1 may be driven in a non-display mode or a sensing mode. For example, the first display DA1 may be driven in a sensing mode while the second display DA2 is driven in a display mode, and the second display DA2 may be driven in a sensing mode while the first display DA1 is driven in a display mode.

That is, according to an embodiment, the first and second displays DA1 and DA2 may display images in different times. For example, when the display device 10 is unfolded as illustrated in FIG. 1A, the first display DA1 may display an image corresponding to the first image data DATA1. Also, when the display device 10 is folded as illustrated in FIG. 1B, the second display DA2 may display an image corresponding to the second image data DATA2.

In an embodiment, at the switch time of the display DA, that is, when the display DA displaying an image is switched while the display device 10 is being driven, the period in which the first image data DATA1 is supplied and the period in which the second image data DATA2 is supplied (or the period in which the command instructing the end of the display mode of one display DA is supplied and the period in which the command instructing the start of the display mode of the other display DA is supplied) may overlap each other. For example, at the switch time at which the display mode of the second display DA2 ends and the display mode of the first display DA1 starts, the period in which the first image data DATA1 is supplied may partially overlap the period in which the second image data DATA2 is supplied. In this case, after the first display DA1 is switched to an "on" state, the second display DA2 may be switched to an "off" state. Accordingly, the display device 10 may consistently display an image.

The first power supply 410 may supply first power ELVDD having a fixed voltage to each of the displays DA while the display device 10 is driven. For example, the first power supply 410 may supply the first power ELVDD having a fixed voltage to the first display DA1 during the display period and the sensing period SP of the first display DA1 and supply the first power ELVDD having the fixed voltage to the second display DA2 during the display period and the sensing period SP of the second display DA2.

Meanwhile, while the display device 10 is driven, the second power supply 420 may change the voltage level of the second power ELVSS to be supplied to each display DA depending on the driving mode of the display DA and supply the same. For example, the first power switch PSW1 may couple the first display DA1 to the first voltage source V1 while the first display DA1 is driven in a display mode, and may couple the first display DA1 to the second voltage source V2 while the first display DA1 is driven in a sensing mode. Similarly, the second power switch PSW2 may couple the second display DA2 to the first voltage source V1 while the second display DA2 is driven in a display mode, and may couple the second display DA2 to the second voltage source V2 while the second display DA2 is driven in a sensing mode.

To this end, the first power switch PSW1 couples the first output port P(O1) to the first input port P(A) while the first display DA1 is driven in a display mode, thereby coupling the first display DA1 to the first voltage source V1. Accordingly, the first display DA1 may be supplied with the second power ELVSS having a low voltage ELVSS_L during each display period.

Also, the first power switch PSW1 couples the first output port P(O1) to the second input port P(B) while the first display DA1 is driven in a sensing mode, thereby coupling the first display DA1 to the second voltage source V2. Accordingly, the first display DA1 may be supplied with the second power ELVSS having a high voltage ELVSS_H during each sensing period SP.

Similarly, the second power switch PSW2 couples the second output port P(O2) to the first input port P(A) while the second display DA2 is driven in a display mode, thereby coupling the second display DA2 to the first voltage source V1. Accordingly, the second display DA2 may be supplied with the second power ELVSS having a low voltage ELVSS_L during each display period.

Also, the second power switch PSW2 couples the second output port P(O2) to the second input port P(B) while the second display DA2 is driven in a sensing mode, thereby coupling the second display DA2 to the second voltage source V2. Accordingly, the second display DA2 may be supplied with the second power ELVSS having a high voltage ELVSS_H during each sensing period SP.

According to an embodiment, the point at which the input port coupled to each of the first and second output ports P(O1) and P(O2), which are coupled to the first and second power switches PSW1 and PSW2, is switched may be the point at which the display DA is switched. At the switch point, the first display data DATA1 and the second display data DATA2 may overlap each other.

Meanwhile, FIG. 8 illustrates the timing at which the first power switch PSW1 is driven and the timing at which the second power switch PSW2 is driven in different waveforms in order to show that the first and second power switches PSW1 and PSW2 couple the first and second output ports P(O1) and P(O2) to different input ports at a specific time. However, the waveforms of the switch control signals input to the first and second power switches PSW1 and PSW2 (or "referred to as "power switch control signals") may suitably vary depending on the structure and/or type of the first and second power switches PSW1 and PSW2.

Schematically describing the driving method of the display device 10 according to the embodiment of FIG. 7 and FIG. 8, first, any one of the first and second displays DA1 and DA2 may display an image while first operating power, which is set so as to enable pixels PX in the display DA to emit light, is being supplied to the corresponding display DA. According to an embodiment, the first operating power may include first power ELVDD having a fixed high voltage and second power ELVSS having a low voltage ELVSS_L set to a set or predetermined level.

Also, during at least one period while the corresponding display DA displays an image, the characteristic information of the pixels in the other display DA may be detected by supplying second operating power, which is set so as to prevent or block the pixels PX in the other display DA from emitting light, thereto. According to an embodiment, the second operating power may include first power ELVDD having a fixed high voltage and second power ELVSS having a high voltage ELVSS_H set to a set or predetermined level. The second power ELVSS having the high voltage ELVSS_H may have electric potential that is equal to or different from that of the first power ELVDD.

For example, during one period of the driving period of the display device 10, the first display DA1 may display an image by supplying the first operating power, which is set so as to enable the first pixels PX1 to emit light, to the first display DA1. Also, during at least one period while the first display DA1 displays an image, the characteristic information of the second pixels PX2 may be detected by supplying the second operating power, which is set so as to prevent or block the second pixels PX2 from emitting light, to the second display DA2. Here, while the characteristic information of the second pixels PX2 is being detected, the first display DA1 may be coupled to the first voltage source V1 of the second power supply 420, and the second display DA2 may be coupled to the second voltage source V2 of the second power supply 420.

Also, during the other one period of the driving period of the display device 10, the second display DA2 may display an image by supplying the first operating power, which is set so as to enable the second pixels PX2 to emit light, to the second display DA2. Also, during at least one period while the second display DA2 displays an image, the characteristic information of the first pixels PX1 may be detected by supplying the second operating power, which is set so as to prevent or block the first pixels PX1 from emitting light, to the first display DA1. Here, while the characteristic information of the first pixels PX1 is being detected, the first display DA1 may be coupled to the second voltage source V2 of the second power supply 420, and the second display DA2 may be coupled to the first voltage source V1 of the second power supply 420.

According to the embodiment of FIG. 7 and FIG. 8, the display device 10 including first and second displays DA1 and DA2, which are driven in different times, is configured such that second power ELVSS having a high voltage ELVSS_H, which prevents or blocks the light-emitting elements EL from emitting light, is supplied in response to the sensing period SP of each of the displays DA. Accordingly, the light-emitting elements EL of the pixels PX driven in the sensing mode are prevented or blocked from emitting light, and the characteristic information of the pixels PX may be detected.

Also, according to the above-described embodiment, when the voltage of the second power ELVSS is changed and supplied depending on the driving mode of each of the first and second displays DA1 and DA2, the first and second displays DA1 and DA2 share a single second power supply 420. For example, the first voltage source V1 and the second voltage source V2, which generate different levels of voltages, are provided in the second power supply 420, whereby the second power supply 420 may be configured to generate a set or predetermined low voltage ELVSS_L and a set or predetermined high voltage ELVSS_H.

As described above, when a single second power supply 420 is formed so as to generate second power ELVSS having two different levels of voltages, the circuit structure of the power component 400 may be simplified, and power consumption may be reduced. For example, according to the above-described embodiment, the circuit structure of the second power supply 420 may be simplified and the power consumption (e.g., static power consumption and/or transition power consumption) may be reduced, compared to the case in which separate second power supplies are configured for the respective displays DA and in which each of the displays DA is driven by changing the voltage level of the second power ELVSS depending on the driving mode of the display DA.

Figure 9:
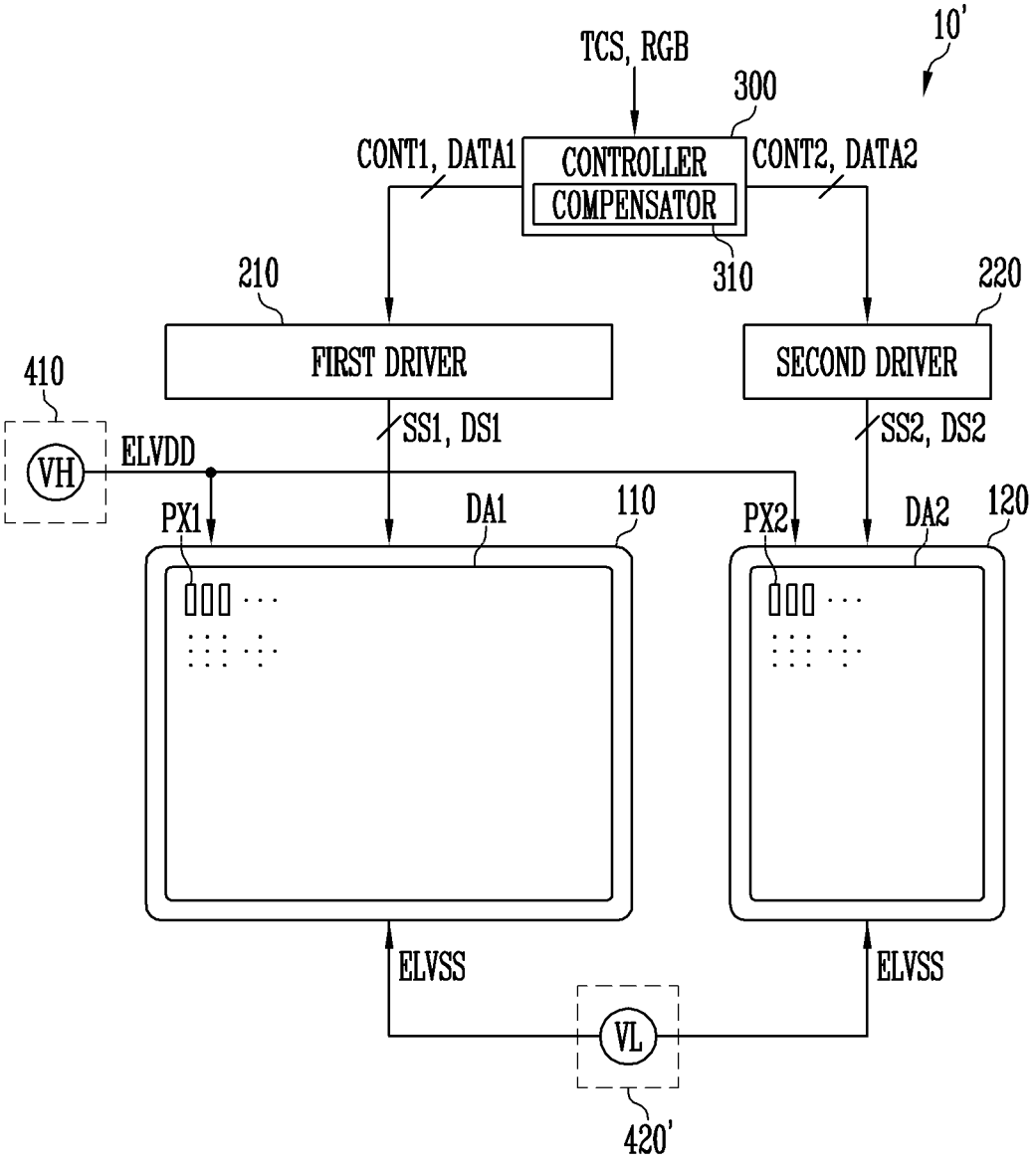
FIG. 9 is a block diagram illustrating a display device according to an embodiment of the present disclosure and illustrates, for example, another embodiment related to the power component illustrated in FIG. 2.
Figure 10:
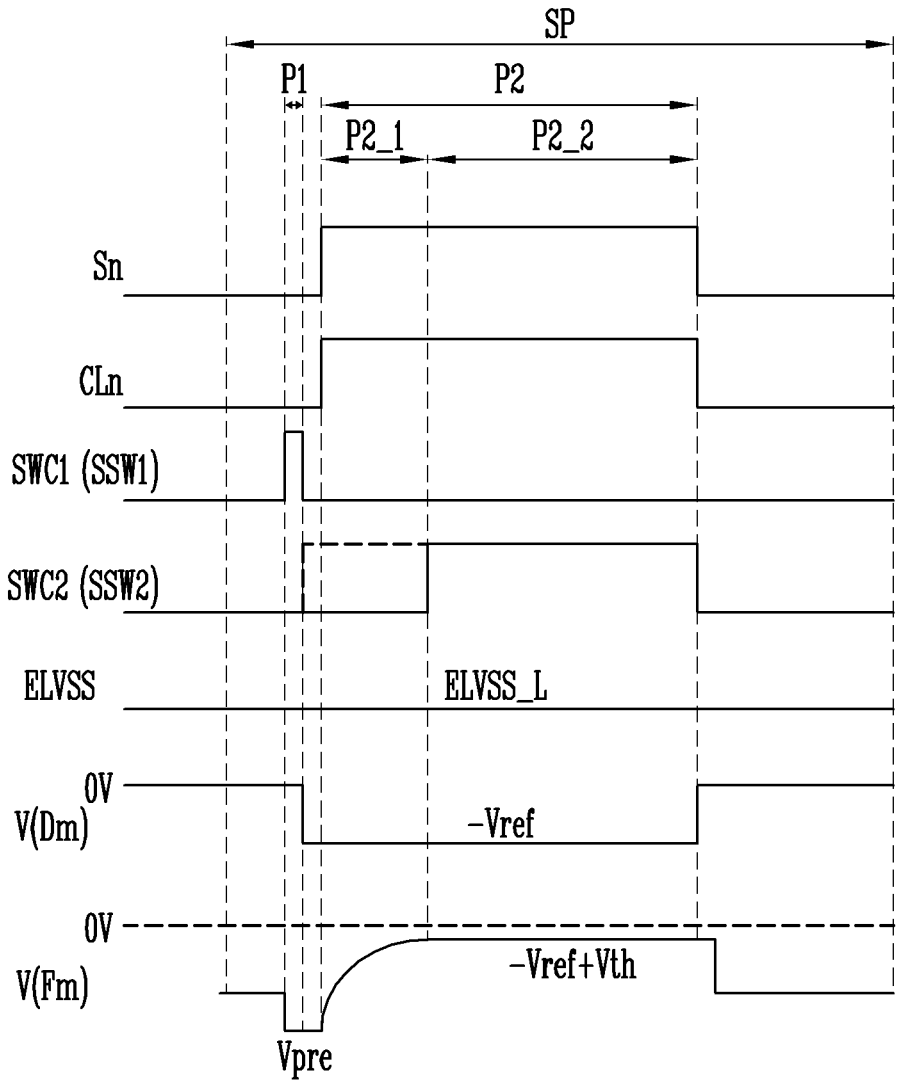
FIG. 10 is a waveform diagram illustrating a driving method of a display device according to the embodiment of FIG. 9 and illustrates, for example, an embodiment of a method for sensing the characteristic information of each pixel during a sensing period.

FIG. 9 is a block diagram illustrating a display device 10' according to an embodiment of the present disclosure and illustrates, for example, another embodiment related to the power component 400 illustrated in FIG. 2. FIG. 10 is a waveform diagram illustrating a driving method of the display device 10' according to the embodiment of FIG. 9 and illustrates, for example, an embodiment of the method for sensing the characteristic information of each pixel PX during a sensing period SP. When the embodiment of FIG. 9 and FIG. 10 is described, the same or similar elements in the above-described embodiments are denoted by the same reference numerals, and a detailed description thereof will be omitted.

Referring to FIG. 9 and FIG. 10 along with FIGS. 2-5, during the display period and the sensing period of each display DA, the second power supply 420' may supply second power ELVSS having a fixed voltage to the display DA. For example, the second power supply 420' includes a single low voltage source VL, which generates second power ELVSS having a low voltage ELVSS_L, which is set to a level at which pixels PX may emit light during a display period, and may supply the second power ELVSS having the low voltage ELVSS_L to each display DA regardless of the driving mode thereof. In this case, the first and second displays DA1 and DA2 may share the second power supply 420' having the single low voltage source VL.

However, in the present embodiment, a reference voltage at a negative level (−Vref) may be supplied to the data line Dm during each sensing period SP. For example, the reference voltage Vref may be a set or predetermined negative voltage set to a level lower than 0V. Hereinafter, the reference voltage −Vref according to the present embodiment is referred to as a "negative reference voltage (−Vref)" in order to differentiate the same from the reference voltage Vref supplied during each sensing period in the above-described embodiment (e.g., the embodiment of FIGS. 6 to 8). Also, the first transistor M1 in the embodiment of FIGS. 6 to 8 has a threshold voltage Vth at a positive level, but the first transistor M1 in the present embodiment may have a threshold voltage at a negative level (−Vth). Therefore, the threshold voltage −Vth of the first transistor M1 according to the present embodiment is represented by adding a minus sign thereto in order to differentiate the same from the threshold voltage Vth of the first transistor M1 in the embodiment of FIGS. 6 to 8.

In the present embodiment, the voltage of the second power ELVSS may be maintained at a fixed voltage level, the structure of the power component 400 may be more simplified, and pixels, of which the characteristic information is to be detected during each sensing period SP, may be prevented or blocked from emitting light by supplying the negative reference voltage −Vref thereto. For example, the negative reference voltage −Vref may be set such that the anode voltage of each pixel PX is equal to or lower than the low voltage ELVSS_L of the second power ELVSS during the sensing period SP thereof. Accordingly, the pixels PX may be prevented or blocked from emitting light during the sensing period SP.

According to an embodiment, the display device 10' may detect the characteristic information of second pixels PX2 during at least one period while the first display DA1 displays an image, and may detect the characteristic information of first pixels PX1 during at least one period while the second display DA2 displays an image. For example, during at least one period of the display period of the first display DA1, the characteristic information of the second pixels PX2 arranged in at least one horizontal line of the second display DA2 may be detected, and during at least one period of the display period of the second display DA2, the characteristic information of the first pixels PX1 arranged in at least one horizontal line of the first display DA1 may be detected.

During the first period P1 of each sensing period SP, a first sensing switch SSW1 is turned on by supplying a first switch control signal SWC1. Accordingly, a precharge voltage Vpre is transmitted to each sensing line Fm, whereby the voltage V(Fm) of the sensing line Fm is initialized to the precharge voltage Vpre. The precharge voltage Vpre may be a voltage that is lower than the negative reference voltage −Vref by the threshold voltage −Vth of the first transistor M1 or higher. For example, the precharge voltage Vpre and the negative reference voltage −Vref may be supplied such that the difference therebetween enables the first transistor M1 to be turned on during at least one period of the sensing period SP. Meanwhile, the period remaining excluding the first period P1 in each sensing period SP, the first sensing switch SSW1 may be turned off.

After the first period P1 ends, the negative reference voltage −Vref is supplied to the data line Dm. Accordingly, the voltage V(Dm) of the data line Dm may be changed to the negative reference voltage −Vref.

During a second period P2 following the first period P1 in the sensing period SP, a scan signal and a control signal are supplied to the scan line Sn and the control line CLn, respectively. For example, after a set or predetermined time since the negative reference voltage −Vref starts to be supplied to the data line Dm, the supply of the scan signal and the control signal may be started. Accordingly, the second transistor M2 and the third transistor M3 are turned on.

When the second transistor M2 is turned on, the negative reference voltage −Vref is transmitted to the first node N1, whereby the first transistor M1 is turned on. Accordingly, the voltage of the second node N2 may be gradually changed to the voltage corresponding to the difference between the negative reference voltage −Vref and the threshold voltage −Vth of the first transistor M1 (−Vref−(−Vth), that is, −Vref+Vth). Here, the storage capacitor Cst may be charged with the voltage corresponding to the threshold voltage −Vth of the first transistor M1. According to an embodiment, the voltage of the second node N2 (e.g., −Vref+Vth) may be equal to or less than the low voltage ELVSS_L of the second power ELVSS, and thus the light-emitting element EL maintains a non-emissive state.

When the third transistor M3 is turned on, the second node N2 is coupled to the sensing line Fm. Accordingly, the voltage of the second node N2 is transmitted to the sensing line Fm.

According to an embodiment, during a first subperiod P2_1, first and second switch control signals SWC1 and SWC2 for turning off first and second sensing switches SSW1 and SSW2 may be supplied. Accordingly, the second node N2 may be floated during the first subperiod P2_1.

After the sensing line Fm is charged with the precharge voltage Vpre, because the sensing line Fm is coupled to the second node N2 through the third transistor M3 and because the negative reference voltage −Vref is supplied to the first node N1, the first transistor M1 is turned on during the first subperiod P2_1. Accordingly, the voltage of the second node N2 steadily increases, and when the voltage difference between the gate electrode and the source electrode of the first transistor M1 becomes the threshold voltage −Vth of the first transistor M1, the first transistor M1 is turned off. Accordingly, the storage capacitor Cst may be charged with the voltage corresponding to the threshold voltage −Vth of the first transistor M1.

During the second subperiod P2_2, the second sensing switch SSW2 is turned on by the second switch control signal SWC2, whereby each sensing line Fm is coupled to the ADC of the corresponding channel of the sensor SSU. Accordingly, information about the threshold voltage Vth of the first transistor M1 may be detected.

In an embodiment, when the voltages of the scan signal and the control signal are changed to a gate-off voltage, the voltage of the second switch control signal SWC2 may also be changed to the gate-off voltage. However, the time at which the second switch control signal SWC2 is supplied may be suitably changed as long as the turn-on period of the third transistor M3 and that of the second sensing switch SSW2 overlap each other.

The ADC converts the characteristic information (information about the threshold voltage Vth and the like) of the first transistor M1 into a second digital value and supplies the second digital value to the compensator 310. The characteristic information of the first transistor M1 may be used to compensate for the characteristic variation and the like of the pixels PX by converting input image data RGB.

Schematically describing the driving method of the display device 10' according to the embodiment of FIG. 9 and FIG. 10, while any one of the first and second displays DA1 and DA2 displays an image, the characteristic information of the pixels PX of the other display DA is detected. For example, during at least one period of each display period in which an image is displayed in the first display DA1 by driving the first display DA1 in a display mode, the characteristic information of the second pixels PX2 of at least one horizontal line in the second display DA2 may be detected.

According to an embodiment, detecting the characteristic information of the second pixels PX2 may include supplying a precharge voltage Vpre of a set or predetermined voltage (hereinafter, referred to as a "first low voltage") to the sensing lines F1 to Fm coupled to the second pixels PX2, supplying the negative reference voltage −Vref of a second low voltage to the sensing lines F1 to Fm, and detecting the characteristic information of the second pixels PX2 by coupling the sensing lines F1 to Fm to the sensor SSU. The second low voltage is set higher than the first low voltage, but may be set to a voltage that may prevent or block the second pixels PX2 from emitting light during the sensing period SP.

Also, the first and second displays DA1 and DA2 may be supplied with the same operating power. For example, while the first display DA1 is driven in a display mode and the second display DA2 is driven in a sensing mode, the first power ELVDD and the second power ELVSS, which have a potential difference therebetween that enables the first and second pixels PX1 and PX2 to emit light, to all of the first and second displays DA1 and DA2. According to an embodiment, the second low voltage corresponding to the negative reference voltage −Vref may be set lower than the voltage of each of the first power ELVDD and the second power ELVSS. Accordingly, the pixels PX driven in the sensing mode may be prevented or blocked from emitting light.

In the above-described embodiment, the characteristic information of the pixels PX, for example, information about the threshold voltage −Vth of the first transistor M1 and the like, may be sensed during the sensing period SP, and the information may be used for data compensation. Accordingly, the characteristic variation between the pixels PX may be compensated for, and each display DA may display an image having uniform quality.

Also, during the sensing period SP for detecting the characteristic information of each pixel PX, the negative reference voltage −Vref is supplied to the pixel PX, whereby the pixel PX may be prevented or blocked from emitting light during the sensing period SP.

According to the display device 10 or 10' and the driving method thereof according to the above-described embodiments, the display device 10 or 10' having multiple displays DA (e.g., first and second displays DA1 and DA2) is configured to compensate for the characteristic variation of pixels PX and the like through a data compensation method, thereby simplifying the structure of each pixel PX and improving image quality. Also, during each sensing period SP for detecting the characteristic information of pixels PX, the pixels PX driven in a sensing mode may be effectively prevented or blocked from emitting light, the circuit structure of the power component 400 may be simplified, and the power consumption may be reduced.

Meanwhile, in the above-described embodiments, an embodiment in which, for each of the first and second displays DA1 and DA2, the characteristic variation of the first and second pixels PX1 and PX2 is compensated for through an external compensation method (e.g., a data conversion method) is disclosed, but the present disclosure is not limited thereto. For example, in another embodiment, only for any one of the first and second displays DA1 and DA2, the characteristic variation of the first or second pixels PX1 or PX2 may be compensated for through an external compensation method. In this case, among the first and second power switches PSW1 and PSW2, only one power switch coupled to the corresponding display DA may be provided.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

In some embodiments, one or more outputs of the different embodiments of the methods and systems of the present disclosure may be transmitted to an electronics device coupled to or having a display device for displaying the one or more outputs or information regarding the one or more outputs of the different embodiments of the methods and systems of the present disclosure.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

According to a display device and a driving method thereof according to embodiments of the present disclosure, the structures of pixels and a power component of a display device including multiple displays may be simplified, and power consumption may be reduced.

Although the technical spirit of the present disclosure has been described in detail with reference to the exemplary embodiments, it should be noted that the exemplary embodiments is illustrative and is not intended to limit the technical spirit of the present disclosure. Also, it will be understood by those of skill in the art that various changes in form and details may be made without departing from the spirit and scope of the present disclosure.

Therefore, the technical scope of the present disclosure should be defined by the technical spirit of the claims rather than the detailed description. Also, all changes or modifications or their equivalents made within the meanings and scope of the claims should be construed as falling within the scope of the present disclosure.

What is claimed is:

1. A display device, comprising:

a first display including first pixels;

a second display including second pixels;

a first driver configured to drive the first display;

a second driver configured to drive the second display;

a controller configured to control the first and second drivers;

a first power supply configured to supply first power to the first and second displays; and a second power supply configured to supply second power to the first and second displays, wherein the second power supply comprises:

a first voltage source configured to generate a first voltage;

a second voltage source configured to generate a second voltage;

a first switch configured to couple the first display to one of the first and second voltage sources; and a second switch configured to couple the second display to one of the first and second voltage sources.

2. The display device according to claim 1, wherein the first display is to be driven in a display mode or in a sensing mode, and wherein the first switch couples the first display to the first voltage source when the first display is driven in the display mode, and couples the first display to the second voltage source when the first display is driven in the sensing mode.

3. The display device according to claim 2, wherein:

the first voltage is set to a low-level voltage for the first pixels to emit light, and the second voltage is set to a high-level voltage for the first pixels to not emit light.

4. The display device according to claim 2, wherein the second display is to be driven in the display mode or the sensing mode, and wherein the second display is driven in the sensing mode when the first display is driven in the display mode.

5. The display device according to claim 4, wherein the second switch couples the second display to the first voltage source when the second display is driven in the display mode, and couples the second display to the second voltage source when the second display is driven in the sensing mode.

6. The display device according to claim 1, wherein each of the first and second pixels comprises:

a light-emitting element coupled between the first power supply and the second power supply;

a first transistor coupled between the first power supply and the light-emitting element, and configured to control a driving current supplied to the light-emitting element in response to a voltage of a first node;

a second transistor coupled between the first node and a data line, the second transistor being turned on when a scan signal is supplied to a scan line;

a third transistor coupled between a sensing line and a second node, the second node being located between the light-emitting element and the first transistor, the third transistor being turned on when a control signal is supplied to a control line; and a storage capacitor coupled between the first node and one electrode of the first transistor or the second node.

7. The display device according to claim 6, wherein each of the first and second drivers comprises:

a scan driver configured to supply the scan signal to the scan line;

a control line driver configured to supply the control signal to the control line;

a data driver configured to supply a data signal or a reference voltage to the data line; and a sensor coupled to the sensing line and configured to generate an output signal corresponding to a voltage of the second node.

8. The display device according to claim 7, wherein the reference voltage is set to a voltage for the first transistor to turn on during each sensing period for detecting characteristic information of the first pixels or the second pixels.

9. The display device according to claim 8, wherein the sensor is to supply a precharge voltage that is lower than the reference voltage to the sensing line before the reference voltage is supplied to the data line.

10. The display device according to claim 7, wherein the controller comprises a compensator configured to convert input image data in response to the output signal from the sensor, and configured to supply the converted image data to the data driver.

11. The display device according to claim 10, wherein the compensator is to convert the input image data so as to compensate for characteristic variation of the first and second pixels.

12. The display device according to claim 1, further comprising:

a base member located between the first and second displays, wherein the first and second displays are located on both sides of the base member so as to overlap each other.

13. A driving method of a display device including a first display comprising first pixels, and a second display comprising second pixels, the driving method comprising:

displaying an image in the first display while supplying a first operating power to cause the first pixels to emit light, to the first display, the first operating power comprising a first voltage power from a first power supply and a second voltage power from a first voltage source of a second power supply, the first voltage power being at a higher potential than the second voltage power; and detecting characteristic information of the second pixels while supplying a second operating power to cause the second pixels to emit no light, to the second display during at least one period while the image is displayed in the first display, the second operating power comprising the first voltage power from the first power supply and a third voltage power from a second voltage source of the second power supply, the third voltage power being different from the first voltage power and the second voltage power, wherein, while the characteristic information of the second pixels is detected, the first display is coupled to the first voltage source of the second power supply and the second display is coupled to the second voltage source of the second power supply.

14. The driving method according to claim 13, further comprising:

displaying an image in the second display by supplying the first operating power to the second display; and detecting characteristic information of the first pixels by supplying the second operating power to the first display during at least one period while the image is displayed in the second display.

15. A driving method of a display device including a first display comprising first pixels, and a second display comprising second pixels, the driving method comprising:

displaying an image in the first display; and detecting characteristic information of the second pixels during at least one period when the image is displayed in the first display, wherein detecting the characteristic information of the second pixels comprises:

supplying a precharge voltage having a first low voltage to sensing lines coupled to the second pixels;

supplying a reference voltage having a second low voltage higher than the first low voltage to cause the second pixels to not emit light, to the sensing lines; and detecting the characteristic information of the second pixels by coupling the sensing lines to a sensor.

16. The driving method according to claim 15, wherein:

a first power and a second power, which have a potential difference therebetween such that the first and second pixels emit light, are supplied to the first and second displays, and the second low voltage is set lower than a voltage of each of the first power and the second power.

* * * * *